US006904917B2

(12) United States Patent
Kitao et al.

(10) Patent No.: US 6,904,917 B2
(45) Date of Patent: Jun. 14, 2005

(54) METHOD OF MANUFACTURING CIGARETTE SUPPRESSING SPREAD OF BURN AND APPARATUS FOR MANUFACTURING CIGARETTE SUPPRESSING SPREAD OF BURN

(75) Inventors: Satoshi Kitao, Yokohama (JP); Keigo Miura, Yokohama (JP); Sadayoshi Matsuura, Tokyo (JP); Fumio Sashide, Tokyo (JP); Tsuyoshi Futamura, Tokyo (JP)

(73) Assignee: Japan Tobacco, Inc., Tokyo (JP)

( * ) Notice: Subject to any disclaimer, the term of this patent is extended or adjusted under 35 U.S.C. 154(b) by 0 days.

(21) Appl. No.: 10/382,841

(22) Filed: Mar. 7, 2003

(65) Prior Publication Data

US 2003/0150466 A1 Aug. 14, 2003

Related U.S. Application Data

(63) Continuation of application No. PCT/JP01/07796, filed on Sep. 7, 2001.

(30) Foreign Application Priority Data

Sep. 8, 2000 (JP) ..... 2000-273800
Sep. 8, 2000 (JP) ..... 2000-273801

(51) Int. Cl.[7] ..... A24C 5/28
(52) U.S. Cl. ..... 131/65; 131/284
(58) Field of Search ..... 131/65, 365, 284, 131/349, 905

(56) References Cited

U.S. PATENT DOCUMENTS 4,619,278 A 10/1986 Smeed et al.
5,450,863 A * 9/1995 Collins et al. ..... 131/365
6,020,969 A 2/2000 Struckhoff et al.
6,725,867 B2 * 4/2004 Peterson et al. ..... 131/365
2003/0145869 A1 * 8/2003 Kitao et al. ..... 131/360

FOREIGN PATENT DOCUMENTS

| | | | |
|---|---|---|---|
| EP | 0483998 | A1 | 5/1992 |
| EP | 0532193 | A1 | 3/1993 |
| EP | 0671505 | A2 | 9/1995 |
| EP | 0671505 | A3 | 9/1995 |
| JP | 59-151880 | A | 8/1984 |
| JP | 63-116684 | A | 5/1988 |
| JP | 64-43177 | A | 2/1989 |
| JP | 4-293478 | A | 10/1992 |
| JP | 2783803 | B2 | 5/1998 |

* cited by examiner

*Primary Examiner*—Dionne A. Walls
(74) *Attorney, Agent, or Firm*—Birch, Stewart, Kolasch & Birch, LLP

(57) ABSTRACT

An apparatus includes a unit which forms burn control agent coated regions on a web of a wrapping paper transferred by a wrapping paper transfer unit at a plurality of positions separated from each other in the longitudinal or in the width direction of the web, a unit which supplies chopped tobacco leaves to the wrapping paper after formation of the coated regions, a roll-up unit which rolls up the wrapping paper on which the chopped tobacco leaves are supplied, and a cigarette cutting unit which cuts the rolled-up wrapping paper together with the chopped tobacco leaves in a predetermined length of the cigarette in the longitudinal direction thereof.

22 Claims, 10 Drawing Sheets

METHOD OF MANUFACTURING CIGARETTE SUPPRESSING SPREAD OF BURN AND APPARATUS FOR MANUFACTURING CIGARETTE SUPPRESSING SPREAD OF BURN

CROSS-REFERENCE TO RELATED APPLICATIONS

This application is a Continuation Application of No. PCT/JP01/07796, filed Sep. 7, 2001, and the PCT application is based upon and claims the benefit of priority from the prior Japanese Patent Applications No. 2000-273800, filed Sep. 8, 2000; and No. 2000-273801, filed Sep. 8, 2000, the entire contents of both of which are incorporated herein by reference.

BACKGROUND OF THE INVENTION

1. Field of the Invention

The present invention relates to a method of manufacturing a cigarette which suppresses a spread of burn and an apparatus for manufacturing a cigarette which suppresses a spread of burn.

2. Description of the Related Art

A cigarette which suppresses a spread of burn is a cigarette structured such that, if it is left not to be smoked after it is lighted, the lighted cigarette ceases to burn, or a cigarette structured such that, if it is erroneously dropped onto a combustible material while the cigarette is left not to be smoked after it is lighted and the lighted cigarette continues to burn, the heat of the burning cigarette is spread into the the combustible material and the burning cigarette case to burn before it burns the combustible material. The cigarette which suppresses the spread of burn has been well known by, for example, Japanese Patent No. 2783803.

In the burn spread suppressing cigarette, which is disclosed in the Japanese Patent specification described above, burn control agent is coated on a tobacco wrapping paper sheet at a plurality of annular regions positioned apart from each other by a predetermined distance in a longitudinal direction of the cigarette. If the burn spread suppressing cigarette is left not to be smoked after an end of the cigarette to be lighted is lighted, the burn of the cigarette is extinguished when the burn of the cigarette reaches the annular region of the burn control agent. On the other hand, if the cigarette is smoked continuously after it is lighted, the burn of the cigarette is not extinguished by the burn control agent even when the burn reaches the annular region of the burn control agent.

In the conventional burn spread suppressing cigarette which is structured as described above, an ordinary burn like in an ordinary cigarette is maintained between the adjacent annular regions of the burn control agent. Therefore, if the conventional burn spread suppressing cigarette is erroneously left on a combustible material and burns ordinarily between the adjacent annular regions of the burn control agent, it does not burn the combustible material but it severely scorches the combustible material depending on a kind of the combustible material, before the burn reaches the annular region of the burn control agent and is extinguished by the burn control agent.

This invention is derived from above described circumstances, an object of the present invention is to provide a method of manufacturing a cigarette which suppresses a spread of burn and an apparatus for manufacturing a cigarette which suppresses a spread of burn, in the cigarette manufactured by this method or this apparatus, when the lighted cigarette is erroneously left on a combustible material, burn of the cigarette is cased, heat of the burning cigarette is spread into a combustible material and does not only burn but also scorch the combustible material, or even if the heat of the burn scorches the combustible material the scorch does not become more severe than in the past.

BRIEF SUMMARY OF THE INVENTION

According to an aspect of the present invention, a method of manufacturing a burn spread suppressing cigarette comprises:

transferring a wrapping paper for a cigarette;

forming a burn control agent coated region on the transferred wrapping paper;

supplying chopped tobacco leaves to the wrapping paper on which the burn control agent coated regions is formed;

rolling up the wrapping paper on which the chopped tobacco leaves are supplied, together with the chopped tobacco leaves; and cutting the rolled-up wrapping paper rolled up, together with the chopped tobacco leaves, to correspond to the longitudinal length of the cigarette.

In the burn spread suppressing cigarette manufactured by the method described above, it is possible to set freely a time required for the lighted cigarette to be ceased after the lighted cigarette is left, and to set freely a burn temperature even if the lighted cigarette is not ceased and continue to burn, by controlling a width of the burn control agent coated region and the number of forming of the burn control agent coated region.

As a result of this, even if the burn spread suppressing cigarette is erroneously left on a combustible material and burns ordinarily, the burn of the cigarette is ceased by the burn control agent or heat of the burn is spread into the combustible material without burn of the combustible material so that the burning cigarette does not scorch the combustible material or, even if the material is scorched, the scorch does not more severe than in the prior art.

Needless to say, in the method as described above, the transferred wrapping paper is a long web before it is cut for individual cigarettes. And, it is possible to form accurately the burn control agent coated region in a desired pattern, in the desired number and in a desired density by forming the burn control agent coated region while the long web-like wrapping paper is transferred.

In the method as described above, it is desirable that, in the formation of the burn control agent coated region, a formation of the burn control agent coated region is performed in synchronism with a cutting operation of the rolled-up wrapping paper.

It is desirable for the method as described above, that the method further comprises an inspection of the burn control agent coated region performed between the formation of the burn control agent coated region and the supply of the chopped tobacco leaves, the inspection inspecting a distribution (including a pattern and the number) and density of the burn control agent coated region formed on the wrapping paper.

The burn control agent coated region can be formed accurately in a desired pattern, in the desired number and in a desired density by forming the burn control agent coated region on the wrapping paper of the transferred long web, in the formation of the burn control agent coated region. And, in the inspection of the burn control agent coated region, the distribution (including the pattern and the number) and density of the burn control agent coated region formed as described above can be inspected accurately.

In this case, in the inspection of the burn control agent coated region, a light is projected on one surface of the wrapping paper for the cigarette after formation of the burn control agent coated region, the light transmitted through the wrapping paper for the cigarette is detected in a side of the other surface of the wrapping paper after formation of the burn control agent coated region, and the distribution and density of the burn control agent coated region formed on the wrapping paper is inspected on a basis of intensity distribution of the transmitted light.

In the method as described above, it is desirable that the burn control agent coated region is formed on a surface of the wrapping paper, the surface becoming an inner surface when the wrapping paper is rolled up for a cigarette.

As a result of this, an outer appearance of the burn spread suppressing cigarette looks like that of the conventional cigarette, a possibility of damaging the burn control agent coated region formed on the wrapping paper for some reasons during storage of the cigarette becomes low remarkably.

In the method as described above, a plurality of burn control agent bands may be formed to extend in a direction which becomes a longitudinal direction when the wrapping paper is rolled up for a cigarette.

In the method as described above, it is desirable that a plurality of bands of the burn control agent are formed to extend intermittently in the direction which becomes the longitudinal direction when the wrapping paper is rolled up for a cigarette, with a predetermined gap in the longitudinal direction.

The predetermined gap noted above can be in correspond to the longitudinal length of the individual cigarette. In this case, it is desirable that the burn control agent coated region is not formed on a portion of the wrapping paper, the portion of the wrapping paper becoming a head of the cigarette when the wrapping paper is rolled up to the cigarette, and the head having a predetermined length in the longitudinal direction of the cigarette.

This results from that the cigarette is rarely left immediately after the head of the cigarette is lighted, and a lightening of the head of the burn spread suppressing cigarette will not be rendered poor.

According to experiments conducted by the inventors of this invention, it is desirable that the predetermined length is set within a range between about 10 mm and about 25 mm.

Further, since the transfer direction of the wrapping paper is a direction in which becomes a longitudinal direction when the wrapping paper is rolled up for a cigarette, it is desirable that, in the formation of the burn control agent coated region, a roller is in contact with the transferred wrapping paper and is rotated in the transfer direction, a burn control agent coated region transfer area corresponding to the burn control agent coated region is formed on the outer circumferential surface of the roller, and the burn control agent supplied form a burn control agent applying device is applied to the outer circumferential surface of the roller by the burn control agent applying device.

The roller is used in the formation of the burn control agent coated region, the width and the diameter (i.e., the circumferential length of the outer circumferential surface) of the roller can be change easily. Therefore, the burn control agent coated region transfer area formed on the outer circumferential surface of the roller can be changed easily.

Alternatively, in the formation of the burn control agent coated region, a nozzle member can be in contact with or is positioned close to the transferred wrapping paper, a plurality of nozzle holes can be formed in the nozzle member, and the burn control agent can be supplied from a burn control agent supply device to the nozzle member.

When the nozzle member provided with a plurality of nozzle holes is used in the formation of the burn control agent coated region, the timing at which the nozzle holes of the nozzle member eject the burn control agent can be changed easily. As a result of this, in a case that the plurality of bands of the burn control agent are formed intermittently with the predetermined gap in the direction which becomes the longitudinal direction when the wrapping paper is rolled up for a cigarette, the longitudinal length of the predetermined gap can be changed easily, compared with in the case that the formation of the burn control agent coated region uses the roller noted above.

According to another aspect of the present invention, an apparatus for manufacturing a burn spread suppressing cigarette comprises:

a wrapping paper transfer unit which transfers a wrapping paper for a cigarette;

a burn control agent coated region forming unit which forms a burn control agent coated region on the wrapping paper transferred by the wrapping paper transfer unit;

a chopped tobacco leaf supply unit which supplies chopped tobacco leaves to the wrapping paper on which the burn control agent coated region is formed by the burn control agent coated region forming unit;

a roll-up unit which rolls up the wrapping paper on which the chopped tobacco leaves are supplied from the chopped tobacco leaf supplying unit, together with the chopped tobacco leaves to form a cigarette; and a cigarette cutting unit which cuts the rolled up wrapping paper, which is rolled up together with the chopped tobacco leaves by the roll-up unit for a cigarette, in a predetermined longitudinal length of the cigarette.

That is, the apparatus as described above manufactures a burn spread suppressing cigarette by the method as described above, so that the cigarette manufactured by the manufacturing apparatus can enjoy all technical advantages that can be obtained by the cigarette manufactured by the method as described above.

Needless to say, in the apparatus as described above, the wrapping paper transferred by the wrapping paper transfer unit is a long web before the wrapping paper is cut into individual cigarettes.

In the apparatus as described above, it is desirable that the burn control agent coated region forming unit forms the burn control agent coated region on the wrapping paper in synchronism with a cutting operation of the rolled-up wrapping paper performed by the cigarette cutting unit.

In the apparatus as described above, it is desirable that the manufacturing apparatus further comprises a burn control agent coated region inspecting unit which inspects a distribution (including the pattern and the number) and density of the burn control agent coated region formed on the wrapping paper after formation of the burn control agent coated region on the wrapping paper by the burn control agent coated region forming unit and before supply of the chopped tobacco leaves performed by the chopped tobacco leaf supply unit.

The burn control agent coated region can be formed accurately in a desired pattern, in the desired number and in a desired density by forming the burn control agent coated region on the wrapping paper of the long web transferred by the wrapping paper transfer unit, by the burn control agent coated region forming unit. And, the inspecting unit can inspect accurately the distribution (including the pattern and the number) and density of the burn control agent coated region formed as described above.

In this case, the burn control agent coated region inspecting unit can project a light on one surface of the wrapping paper for a cigarette after formation of the burn control agent coated region, can detect the light transmitted through the wrapping paper for the cigarette in a side of the other surface of the wrapping paper sheet after formation of the burn control agent coated region, and can inspect the distribution and density of the burn control agent coated region formed on the wrapping paper on a basis of intensity distribution of the transmitted light.

In the apparatus as described above, it is desirable that the burn control agent coated region forming unit is arranged to be in contact with the wrapping paper transferred by the wrapping paper transfer unit, and comprises a wrapping paper shift unit which selectively shifts the wrapping paper transferred by the wrapping paper transfer unit to be brought into contact with the burn control agent coated region forming unit.

In this case, it is desirable that the wrapping paper shift unit shifts the wrapping paper to separate from the burn control agent coated region forming unit while the transfer of the wrapping paper by the wrapping paper transfer unit is stopped.

In the apparatus as described above, it is desirable that the burn control agent coated region forming unit forms the burn control agent coated region on that surface of the wrapping paper which becomes an inner surface when the wrapping paper is rolled up for a cigarette.

As a result of this, an outer appearance of the burn spread suppressing cigarette looks like that of the conventional cigarette, and a possibility of damaging the burn control agent coated region formed on the wrapping paper for some reasons during storage of the cigarette becomes low remarkably.

In the apparatus as described above, the burn control agent coated region forming unit can form a plurality of bands of the burn control agent to extend in a direction which becomes a longitudinal direction with the wrapping paper is rolled up for a cigarette.

In the apparatus as described above, the burn control agent coated region forming unit can form a plurality of bands of the burn control agent to extend intermittently in the direction which becomes the longitudinal direction when the wrapping paper is rolled up for a cigarette, with a predetermined gap in the longitudinal direction.

The predetermined gap noted above can be in correspond to the longitudinal length for the individual cigarette. In this case, it is desirable that the burn control agent coated region is not formed on a position of the wrapping paper, the portion of the wrapping paper becoming a head of the cigarette when the wrapping paper is rolled up to the cigarette, and the head having a predetermined length in the longitudinal direction of the cigarette.

This results from that the cigarette is rarely left immediately after the head of the cigarette is lighted, and a lightening of the head of the burn spread suppressing cigarette will not be rendered poor.

According to experiments conducted by the inventor of the present invention, it is desirable that the predetermined length is set within a range between about 10 mm and about 25 mm.

Further, since the transfer direction of the wrapping paper is a direction which becomes a longitudinal direction when the wrapping paper is rolled up for a cigarette, it is possible that the burn control agent coated region forming unit includes a roller that is in contact with the wrapping paper transferred by the wrapping paper transfer unit and is rotated in the transfer direction of the wrapping paper, a burn control agent coated region transfer area corresponding to the burn control agent coated region and formed on the outer circumferential surface of the roller, and a burn control agent applying device which supplies the burn control agent onto the outer circumferential surface of the roller and applies the burn control agent to the outer circumferential surface of the roller.

Alternatively, the burn control agent coated region forming unit includes a nozzle member which is in contact with or is positioned close to the wrapping paper transferred by the wrapping paper transfer unit, a plurality of nozzle holes formed in the nozzle member, and a burn control agent supply device which supplies the burn control agent to the nozzle member.

Where the burn control agent coated region forming unit uses the roller, the width and the diameter (i.e., the circumferential length of the outer circumferential surface) of the roller can be change easily. Therefore, the burn control agent coated region transfer area formed on the outer circumferential surface of the roller can be changed easily.

Where the burn control agent coated region forming unit uses the nozzle member noted above, the timing at which the nozzle holes of the nozzle member eject the burn control agent can be changed easily. As a result of this, in a case that a plurality of bands of the burn control agent are formed intermittently with the predetermined gap in the direction which becomes the longitudinal direction when the wrapping paper is rolled up for a cigarette, by the burn control agent coated region forming unit, the longitudinal length of the predetermined gap can be changed easily, compared within the case that the burn control agent coated region forming unit uses the roller noted above.

In following descriptions, an apparatus for manufacturing a cigarette which suppresses a spread of burn, by a manufacturing method of the burn spread suppressing cigarette, the method being according to one embodiment of the present invention, together with various modifications of the manufacturing apparatus, will be explained in detail with reference to accompanying drawings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

At first, with reference to FIG. 1, an entire structure of a cigarette manufacturing apparatus for manufacturing a cigarette which suppresses a spread of burn will be described schematically, the apparatus manufacturing the burn spread suppressing cigarette by a method of manufacturing the burn spread suppressing cigarette and, the method according to one embodiment of the present invention.

Figure 1:
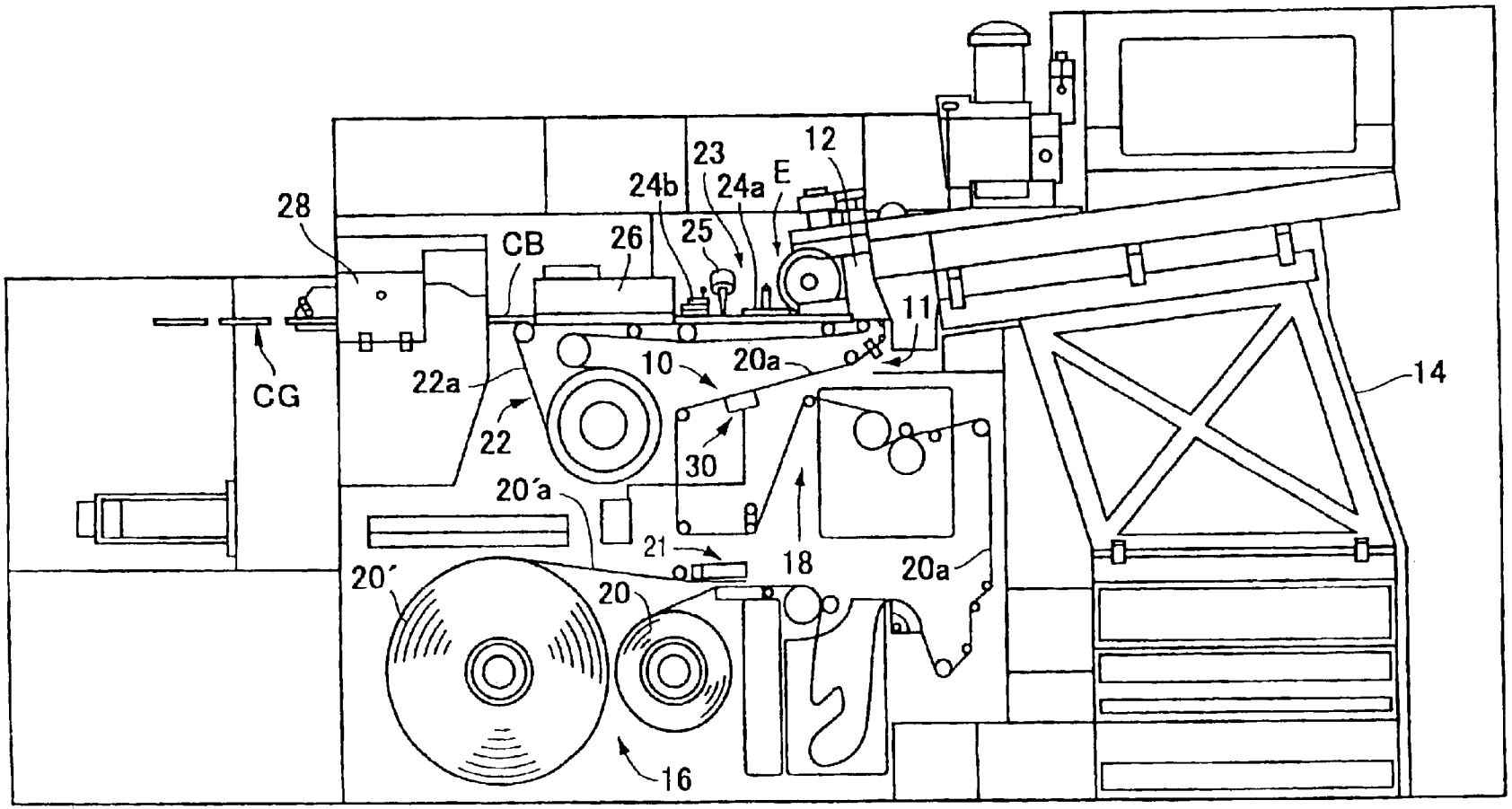
FIG. 1 schematically shows an entire structure of an apparatus for manufacturing a cigarette which suppresses a spread of burn, the apparatus manufacturing the cigarette by a method of manufacturing the burn spread suppressing cigarette, the method according to one embodiment of the present invention, and the apparatus including a device which inspects a cigarette wrapping paper used for the burn spread suppressing cigarette.

A structure of the apparatus for manufacturing a burn spread suppressing cigarette shown in FIG. 1 is equal to a structure of a conventional cigarette manufacturing apparatus with excepting a cigarette wrapping paper manufacturing device 10 and a cigarette wrapping paper inspecting unit 11. The device 10 is used for manufacturing a cigarette wrapping paper suppressing a spread of burn, and the unit 11 is used for inspecting the cigarette wrapping paper suppressing a spread of burn.

The burn spread suppressing cigarette manufacturing apparatus shown in FIG. 1 comprises an air permeable transfer unit 12 which transfers chopped tobacco leaves. The chopped tobacco leaf transfer unit 12 uses an air permeable transfer belt. A passageway member 14 which is used for supplying chopped tobacco leaves extends from a chopped tobacco leaf supply source (not shown) to the chopped tobacco leaf transfer unit 12. The chopped tobacco leaves are transferred by an air stream from the chopped tobacco leaf supply source (not shown) to the chopped tobacco leaf transfer unit 12 through the chopped tobacco leaf supply passageway member 14.

The chopped tobacco leaves supplied from the chopped tobacco leaf supply source are pressed on the chopped tobacco leaf transfer unit 12 at an end of the chopped tobacco leaf supply passageway member 14 by the air stream and forms a slender band having a predetermined width and extending along a center line in the transfer direction (longitudinal direction) of the chopped tobacco leaf transfer unit 2.

An end of a main portion of a wrapping paper transfer unit 18 which transfers a cigarette wrapping paper from a cigarette wrapping paper supply source 16 is positioned at another end E of the chopped tobacco leaf transfer unit 12 in the transfer direction. In this embodiment, a roll 20 of a long web which is used as a raw material of the cigarette wrapping paper and from which a cigarette wrapping paper sheet for an individual cigarette is cut is rotatably arranged in the wrapping paper supply source 16, and the long web 20*a* withdrawn from the roll 20 by the main portion of the wrapping paper transfer unit 18 is transferred to the above described end of the main portion of the unit 18 via a slackening preventing mechanism.

In this embodiment, the main portion of the wrapping paper transfer unit 18 includes a large number of pairs of tension rollers, pairs of guide rollers and pairs of driving rollers.

An additional roll 20' which is the same as the roll 20 is also arranged rotatable in the wrapping paper supply source 16. A starting end of a web 20'*a* of the additional roll 20' faces the long web 20*a* withdrawn from the roll 20 by the wrapping paper transfer unit 18, at an automatic joining machine 21. If a final end of the web 20*a* supplied from the roll 20 is detected by the automatic joining machine 21, the automatic joining machine 21 joins the starting end of the web 20'*a* of the additional roll 20' to the final end of the web 20*a* of the roll 20. As a result of this, the web 20'*a* of the additional roll 20' is transferred toward the above described end of the main portion of the wrapping paper transfer unit 18 in succession to the web 20*a* of the roll 20.

The wrapping paper transfer unit 18 has a wrapping paper supporting and transferring device 22 arranged in a downstream of the end of the main portion. In this embodiment, the wrapping paper supporting and transferring device 22 uses transfer belt 22*a* supported by a plurality of guide rollers and driving rollers, and the web 20*a* or 20'*a* coming from the end of the main portion is laid on an upper horizontal moving portion of the transfer belt 22*a* and is transferred by the transfer belt 22*a*.

A tongue shaped member (not shown) is arranged at the end E of the chopped tobacco leaf transfer unit 12 in the transfer direction, and the chopped tobacco leaves are led by the tongue shaped member at the end E onto the web 20*a* or 20'*a* on the upper horizontal moving portion of the transfer belt 22*a*. The transfer direction of the web 20*a* or 20'*a* by the upper horizontal moving portion of the transfer belt 22*a* is equal to the transfer direction of the chopped tobacco leaves transferred by the chopped tobacco leaf transfer unit 12, and the center line of the transfer direction of the chopped tobacco leaf transfer unit 12 corresponds in a vertical direction to the center line of the transfer direction of the upper horizontal moving portion of the transfer belt 22*a*. Therefore, the chopped tobacco leaves led by the tongue member from the end E of the chopped tobacco leaf transfer unit 12 in the transfer direction onto the web 20*a* or 20'*a* on the upper horizontal moving portion of the transfer belt 22*a* is deposited on the web 20*a* or 20'*a* to form a slender band extending along the center line of the transfer direction of the web 20*a* or 20'*a*.

A roll-up unit 23 is arranged along the upper horizontal moving portion of the transfer belt 22*a*. The roll-up unit 23 rolls the web 20*a* or 20'*a* on which the chopped tobacco leaves are deposited to form the slender band on the upper horizontal moving portion of the transfer belt 22*a*, up to the shape of a cigarette, i.e., in the form of a long cylinder, while the upper horizontal moving portion of the transfer belt 22*a* is advanced.

The roll-up unit 23 includes roll-up devices 24*a*, 24*b*, a paste applying device 25, and a paste drying device 26, and these devices are arranged along the transfer direction of the upper horizontal moving portion. The first roll-up device 24*a* stands both side portions of the web 20*a* or 20'*a* on which the chopped tobacco leaves are deposited to form a slender band on the upper horizontal moving portion, up to form a substantially U-shaped cross section and, then, curls one of the side portions to wrap the chopped tobacco leaves of the slender band. The paste applying device 25 applies a paste to the edge of another of the side portions of the web 20*a* or 20'*a* that still have been stood up. The second roll-up device 24*b* curls the remained stood side portion of the web 20*a* or 20'*a*, on the edge of which the paste has been applied, onto the edge of the curled side portion that has been curled tubular as described above to fix the edge of the secondary curled side portion to the edge of the firstly curled side portion with the paste. As a result of this, the web 20*a* or 20'*a* is formed into a long cylindrical rod CB with the chopped tobacco leaves being held therein.

The long rod CB is passed through the paste drying device 26 to dry the paste, and, then, the rod CB is cut into a plurality of cigarettes CG each having a predetermined length by a cutting unit 28 arranged close to the paste drying device 26.

That is, the transfer direction of the long web 20*a* or 20'*a* of the wrapping paper which is transferred by the wrapping paper transfer unit 18, is a longitudinal direction of the long web 20*a* or 20'*a* of the wrapping paper after the web 20*a* or 20'*a* is rolled up in the form of the long rod CB for cigarettes.

The above described structure of the apparatus for manufacturing a burn spread suppressing cigarette shown in FIG. 1, is the same as the structure of the conventional cigarette manufacturing apparatus.

The apparatus 10 for manufacturing a cigarette wrapping paper suppressing the spread of burn, has a novel structure in the burn spread suppressing cigarette manufacturing apparatus shown in FIG. 1, and comprises a unit 30 which forms a burn control agent coated region, the unit 30 being used in combination with the main portion of the wrapping paper transfer unit 18.

Figure 2:
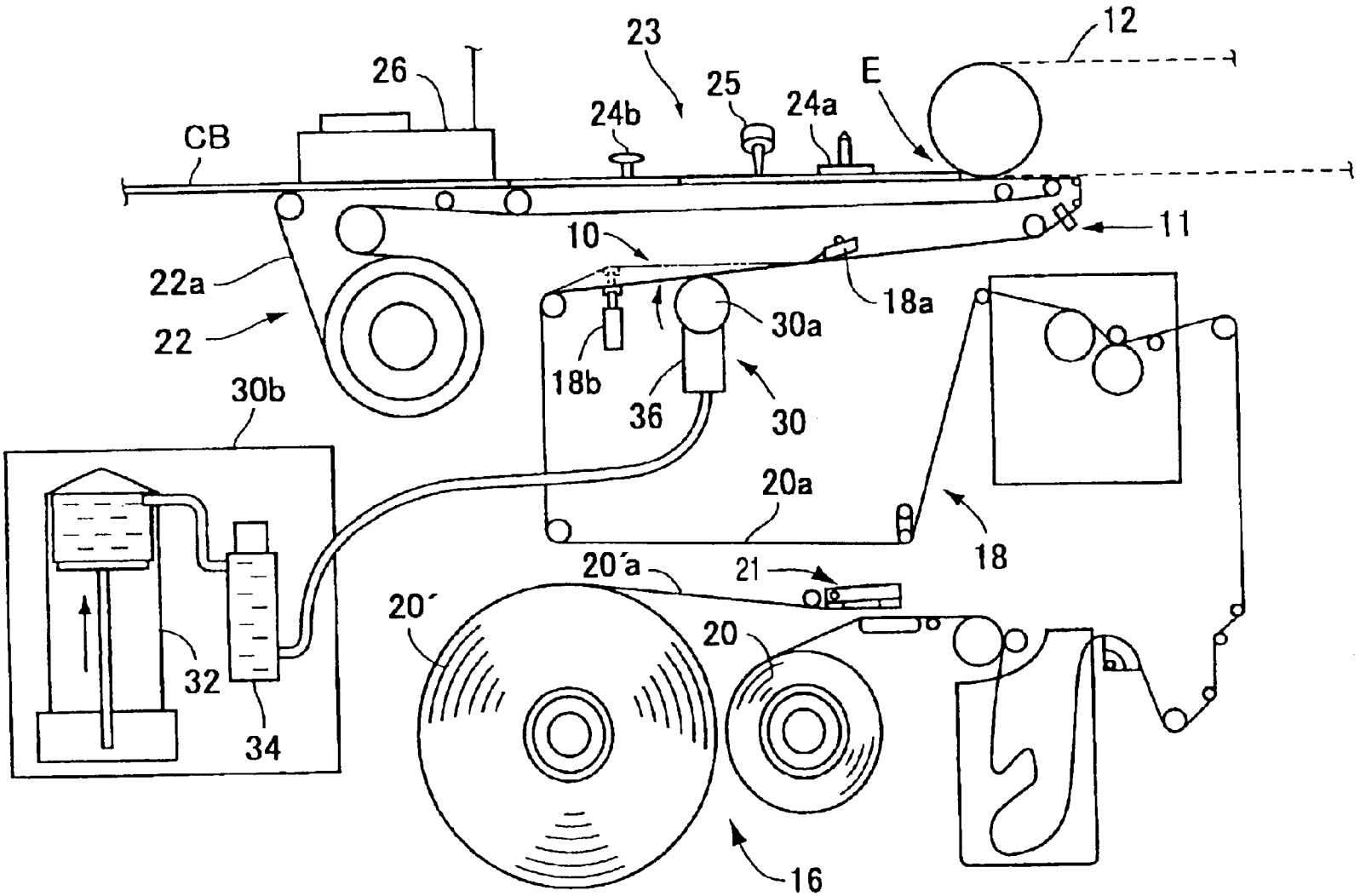
FIG. 2 is an enlarged view showing an unit, together with various members and mechanisms near around the unit, which forms burn control agent coated regions on the cigarette wrapping paper, the unit having a novel structure and included in the apparatus for manufacturing the burn spread suppressing cigarette shown in FIG. 1.

Next, the structure of the burn control agent coated region forming unit 30 will be described in detail with reference to FIG. 2 in addition to FIG. 1. In FIG. 2, the burn control agent coated region forming unit 30 of the manufacturing apparatus for manufacturing a burn spread suppressing cigarette shown in FIG. 1, is shown in an enlarged fashion together with various members and mechanisms near around the unit 30.

The burn control agent coated region forming unit 30 forms a burn control agent coated region in a desired pattern on a surface of the long web 20*a* or 20'*a* of the wrapping paper transferred by the main portion of the wrapping paper transfer unit 18, by applying a burn control agent for controlling a burn of the wrapping paper of the cigarette CG, the surface of the long web 20*a* or 20'*a* on which the burn control agent coated region is formed being located inside when the web 20*a* or 20'*a* is rolled up to make the long rod for cigarettes. In this embodiment, the burn control agent coated region forming unit 30 forms a plurality of burn control agent coated regions of a plurality of bands of a burn control agent on the surface of the web 20*a* or 20'*a* which will be located inside as described above, and these bands extend in the direction which will become a longitudinal direction when the web 20*a* or 20'*a* is rolled up to make the long rod for cigarettes, i.e., extend in the transfer direction of the long web 20*a* or 20'*a* of the wrapping paper transferred by the wrapping paper transfer unit 18 in this embodiment.

The burn control agent coated region forming unit 30 comprises a roller 30*a* and a burn control agent applying device 30*b*. The roller 30*a* is capable of contact with one surface of the long web 20*a* or 20'*a* of the wrapping paper transferred by the main portion of the wrapping paper transfer unit 18 and is rotatable in the transfer direction, and the burn control agent applying device 30*b* supplies a burn control agent onto the outer circumferential surface of the roller 30*a* and applies the burn control agent to the outer circumferential surface of the roller 30*a*. The roller 30*a* is rotated by a rotation driving source (not shown) included in the apparatus for manufacturing a burn spread suppressing cigarette shown in FIG. 1 in a rotating direction and at a peripheral speed conforming with the transfer direction and transfer speed of the long web 20*a* or 20'*a* of the wrapping paper.

The above described one surface of the long web 20*a* or 20'*a* of the wrapping paper with which the roller 30*a* in contact becomes an inside surface when the long web 20*a* or 20'*a* is rolled up with holding of the chopped tobacco leaves to form the long rod for cigarettes.

The burn control agent applying device 30*b* includes a burn control agent tank 32, a pump 34 with a control means connected to the burn control agent tank 32, and a burn control agent applying member 36. The applying member 36 is in contact with the outer circumferential surface of the roller 30*a* and applies the burn control agent supplied from the burn control agent tank 32 by the pump 34 with the control means onto the outer circumferential surface of the roller 30*a*.

The wrapping paper transfer unit 18 includes a wrapping paper position control device 18*a* and a wrapping paper shift unit 18*b*, both of which are arranged in the vicinity of the roller 30*a* of the unit 30. The position control device 18*a* controls the position of the long web 20*a* or 20'*a* relative to the outer circumferential surface of the roller 30*a* in the width direction of the long web 20*a* or 20'*a* of the wrapping paper. And, the wrapping paper shift unit 18*b* shifts the long web 20*a* or 20'*a* of the wrapping paper transferred by the wrapping paper transfer unit 18 to be brought into contact with or to be separated from the outer circumferential surface of the roller 30*a*, selectively. While the apparatus for manufacturing a burn spread suppressing cigarette shown in FIG. 1 is not operated, the wrapping paper shift unit 18*b* separates the web 20*a* or 20'*a* from the outer circumferential surface of the roller 30*a*, as denoted by a two dots chain line in FIG. 2. On the other hand, while the apparatus for manufacturing a burn spread suppressing cigarette, shown in FIG. 1, is operated, the wrapping paper shift unit 18*b* makes the web 20*a* or 20'*a* being in contact with the outer circumferential surface of the roller 30*a*, as denoted by a solid line in FIG. 1.

Figure 3A:
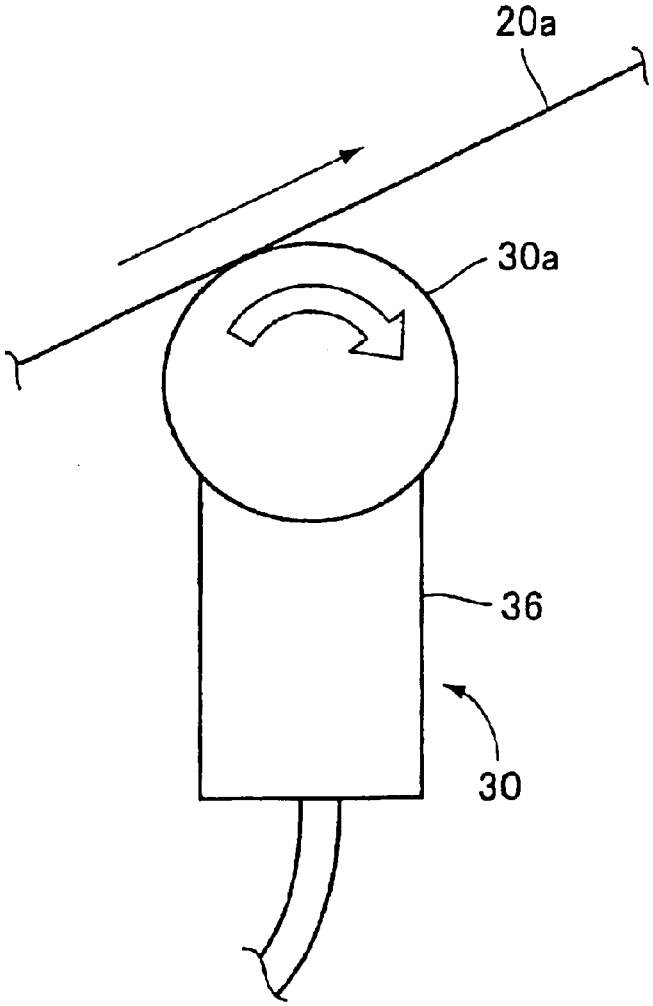
FIG. 3A is a side view showing in an enlarged fashion a roller and a burn control agent applying device, both of which are included in the burn control agent coated region forming unit shown in FIG. 2, and a long web of the wrapping paper transferred by a wrapping paper transfer unit.
Figure 3B:
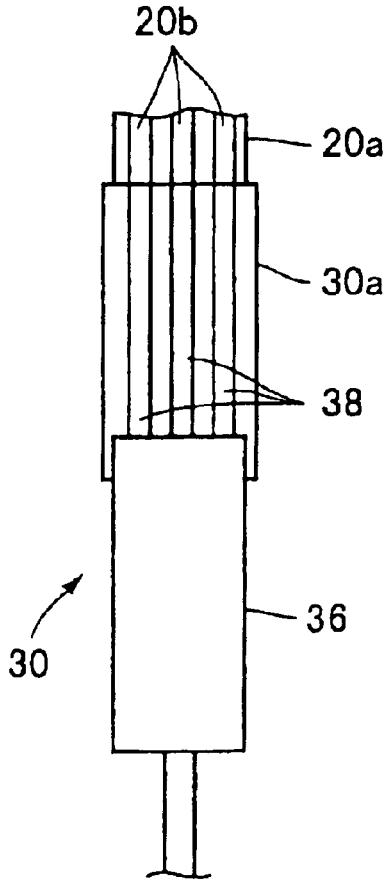
FIG. 3B is a front view showing the roller, the burn control agent applying device and the web, these shown in FIG. 3A.

Now, the structure of the roller 30*a* included in the burn contract agent coated region forming unit 30 will be described in detail with reference to FIGS. 3A and 3B. FIG. 3A is a side view showing in an enlarged fashion the roller 30*a*, the burn control agent applying device 36, and the long web 20*a* of the wrapping paper transferred by the wrapping paper transfer unit 18, the roller 30*a* and the applying device 36 being included in the burn control agent coated region forming unit 30. On the other hand, FIG. 3B is a front view showing the roller 30*a*, the burn control agent applying device 36 and the web 20*a*, all of which are shown in FIG. 3A.

Burn control agent coated region transfer areas are formed on the outer circumferential surface of the roller 30*a* to correspond to the pattern and the number of the burn control agent coated regions to be formed on one surface of the web 20*b* or 20'*b* by the burn control agent coated region forming unit 30. In this embodiment, a plurality of band-shaped burn control agent coated region transfer areas 38 are formed on the outer circumferential surface and extend in the circumferential direction. The band-shaped transfer areas 38 are arranged in the width direction to correspond to a plurality of bands 20*b* of burn control agent to be formed on the web 20*a* or 20'*a* to extend in the transfer direction of the web 20*a* or 20'*a*.

The number of the burn control agent coated region transfer areas 38, the width of each of the burn control agent coated region transfer areas 38, and the distance between the adjacent burn control agent coated region transfer areas 38 correspond to the number of the bands 20*b* of the burn control agent, the width of each of the bands 20*b* and the distance between the adjacent bands 20*b*, respectively, to be formed on one surface of the web 20*a* or 20'*a* by the burn control agent coated region forming unit 30.

The length of each of the plural burn control agent coated region transfer areas 38 can be set within the range of the length of the outer circumferential surface of the roller 30*a* in its circumferential direction.

FIGS. 4A, 4B, 4C and 4D show various examples of a plurality of bands of the burn control agent which are formed on one surface of the long web 20*a* of the wrapping paper transferred by the wrapping paper transfer unit 30, by the various burn control agent coated region transfer areas 38 on the outer circumferential surface of the roller 30*a*. A reference letter L shown in these Figures denotes the length of a single cigarette CG which is prepared by cutting the long rod CB for cigarettes by the cutting unit 28 in a predetermined length after the wrapping paper forming the web 20*a* is rolled up by the roll-up unit 23 shown in FIG. 1 to form the long rod for cigarettes.

Figures 4A, 4B, 4C, 4D:
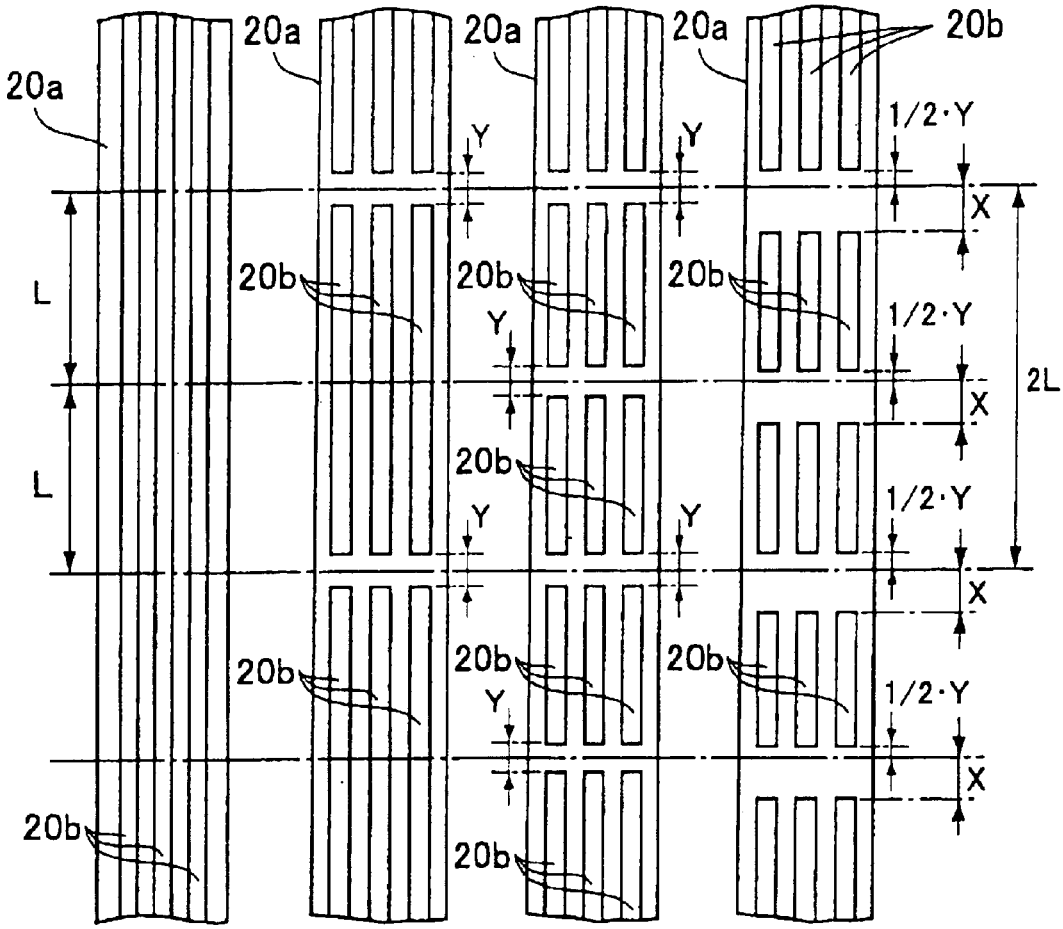
FIGS. 4A, 4B, 4C and 4D show various examples of a plurality of bands of the burn control agent formed on one surface of the long web of a wrapping paper by the burn control agent coated region forming unit shown in FIG. 2 while the wrapping paper is transferred by the wrapping paper transfer unit, the bands of the burn control agent being burn control agent coated regions formed by various burn control agent coated region transfer areas on the outer circumferential surface of the roller of the burn control agent coated region forming unit.

FIG. 4A shows a plurality of bands 20*b* of the burn control agent formed continuously in the transfer direction of the web 20*a* from the leading end to the trailing end of the long web 20*a* of the wrapping paper. The plural continuous bands 20*b* of the burn control agent are obtained by continuously forming a plurality of burn control agent transfer regions 38 on the outer circumferential surface of the roller 30*a* in the circumferential direction.

FIG. 4B shows a plurality of groups each having a plurality of bands 20*b* of the burn control agent, these groups being formed intermittently with a first predetermined gap therebetween in the transfer direction of the web 20*a* (that is, the longitudinal direction of the web 20*a* of the wrapping paper after the wrapping paper is rolled up by the roll-up device 23 shown in FIG. 1 to form the long rod CB for cigarettes) between the leading end and the trailing end of the long web 20*a* of the wrapping paper. The distance between the adjacent two first gaps corresponds to the length 2L for two cigarettes CG.

The plural groups of the bands 20*b* of the burn control agent formed intermittently with the first predetermined gap of the distance Y therebetween and shown in FIG. 4B can be formed by interposing the first predetermined gap of the distance Y into the plurality of continuous burn control agent coated region transfer areas 38 for the continuous burn control agent coated regions shown in FIG. 4A at every positions located away from each other by the length 2L in the circumferential direction on the outer circumferential surface of the roller 30*a*, in this case the roller 30*a* having a circumferential length of an integral number of times as much as the length 2L for two cigarettes CG.

The distance Y between two adjacent groups of the plural bands 20*b* of the burn control agent in the longitudinal direction can be set freely.

FIG. 4C shows a plurality of groups each having a plurality of bands 20*b* of the burn control agent, these groups being formed intermittently with the first predetermined gap therebetween in the transfer direction of the web 20*a*, that is, the longitudinal direction of the web 20*a* of the wrapping paper after the wrapping paper is rolled up by the roll-up device 23 shown in FIG. 1 to form the long rod CB for cigarettes, between the leading end and the trailing end of the long web 20*a* of the wrapping paper. But, the distance between the adjacent two first gaps in FIG. 4C is one half of that between the adjacent two first gaps in FIG. 4B and corresponds to the length L of a single cigarette CG. Further, it is possible to section the distance corresponding to the length L into desirable more short distances.

Also, in this case, the distance Y between two adjacent groups of the plural bands 20*b* of the burn control agent in the longitudinal direction can be set freely.

The plural groups of the bands 20*b* of the burn control agent formed intermittently with the first predetermined gap of the distance Y therebetween and shown in FIG. 4C can be formed by interposing the first predetermined gap of the distance Y into the plural continuous burn control agent coated region transfer areas 38 for the continuous burn control agent coated regions 20*b* shown in FIG. 4A at every positions located away from each other by the length L in the circumferential direction on the outer circumferential surface of the roller 30*a*, in this case the roller 30*a* having a circumferential length of an integral number of times as much as the length L for the single cigarette CG.

Also, the plural groups of the bands 20*b* of the burn control agent formed intermittently with the first predetermined gap of the distance Y therebetween and shown in FIG. 4C can be formed by firstly interposing the first predetermined gap of the distance Y into the plural continuous burn control agent coated region transfer areas 38 for the continuous burn control agent coated regions 20*b* shown in FIG. 4A at every positions located away from each other by the length 2L in circumferential direction on the outer circumference of the roller 30*a*, and by secondly further interposing the first predetermined gap of the distance Y into one group of the plural firstly sectioned burn control agent coated regions 20*b* as described above at a center of the group in the circumferential direction of the outer circumference of the roller 30*a*, in this case the roller 30*a* having a circumferential length of an integral number of times as much as the length L of the single cigarette.

FIG. 4D shows a plurality of groups each having a plurality of bands 20*b* of the burn control agent, these groups being formed intermittently with a second predetermined gap therebetween in the transfer direction of the web 20*a* (that is, the longitudinal direction of the web 20*a* of the wrapping paper after the wrapping paper is rolled up by the roll-up device 23 shown in FIG. 1 to form the long rod CB for cigarettes between the leading end and the trailing end of the long web 20*a* of the wrapping paper. It should be noted that the second predetermined gap includes a X distance portion and a ½·Y distance portion. The X distance portion corresponds to a head (an end to be lighted) of the cigarette CG after the long web 20*a* of the wrapping paper is rolled up to form the long rod CB for cigarettes by the wrapping paper roll-up unit 23 shown in FIG. 1 and the long rod CB is cut into a plurality of cigarettes CG each having the predetermined length by the cutting unit 28. This means that the burn control agent coated regions of the bands 20*b* are not formed on the wrapping paper of the cigarette CG at the head of the cigarette CG by the distance X in the longitudinal direction thereof.

The distance X noted above can be set freely within a range of between about 10 mm and about 25 mm.

The ½·Y distance portion corresponds to an end of the cigarette CG, the end being opposite to the head (the end to be lighted) of the cigarette CG after the long web 20*a* of the wrapping paper is rolled up to form the long rod CB for cigarettes by the wrapping paper roll-up unit 23 shown in FIG. 1 and the long rod CB is cut into a plurality of cigarettes CG each having the predetermined length by the cutting unit 28. This means that the burn control agent coated regions of the bands 20*b* are also not formed on the wrapping paper of the cigarette CG at the end of the cigarette located opposite to the head thereof by the distance ½·Y in the longitudinal direction thereof.

In the web 20*a* shown in each of FIGS. 4B and 4C, the portion of the distance Y between one group of the plural bands 20*b* of the burn control agent and the succeeding group of the plural bands 20*b* of the burn control agent in the longitudinal direction provides a zone of a distance ½·Y on which the burn control agent is not coated, on one end portion or both end portions of the cigarette CG after the long web 20*a* of the wrapping paper is rolled up by the wrapping paper roll-up unit 23 shown in FIG. 1 and the long rod CB is cut into a plurality of cigarettes CG each having the predetermined length by the cutting unit 28. This means that the burn control agent coated regions of the bands 20*b* are not formed on one end portion or the both end portions of the wrapping paper of the cigarette CG by the distance ½·Y in the longitudinal direction thereof.

The ½·Y distance zone on which the burn control agent is not coated prevents the cutting unit 28 from coming into contact with the bands 20*b* of the burn control agent and from lowering the sharpness thereof when the long rod CB of wrapping paper for cigarettes is cut into cigarettes CG by the cutting unit 28.

Figure 4E:
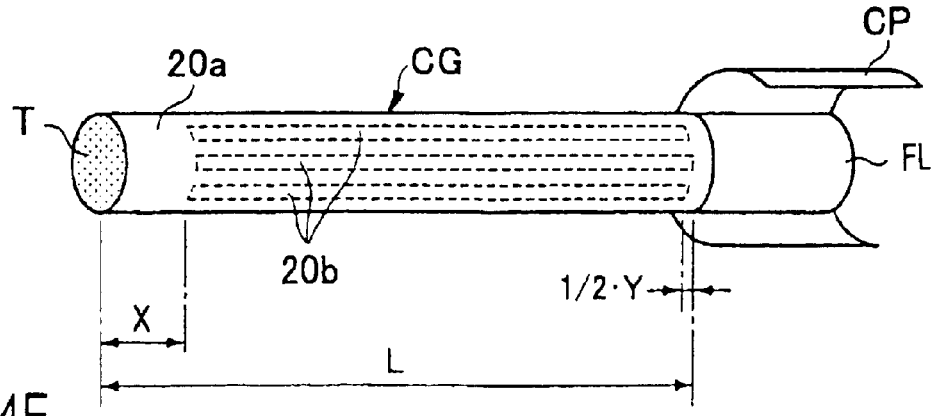
FIG. 4E is a perspective view showing the burn spread suppressing cigarette with a chip paper of a filter being cut to open, the cigarette being manufactured by the burn spread suppressing cigarette manufacturing apparatus shown in FIG. 1 and using the long web of the wrapping paper shown in FIG. 4D.

FIG. 4E shows the cigarette CG with a filter FL in a manner that a chip paper of the filter FL is cut to open. The cigarette CG is formed by rolling up the web 20*a* of the wrapping paper shown in FIG. 4D to hold the chopped tobacco leaves T by the roll-up unit 23 shown in FIG. 1 to form a long rod CB for cigarettes and, then, by cutting the long rod CB into a plurality of cigarettes CG each having the predetermined length by the cutting unit 28, and the chip paper CP of the filter FL is attached to the ½·Y distance zone, on which the burn control agent is not coated, at the end portion of the cigarette CG located opposite to the head (the end to be lighted) thereof.

The zone of the prescribed distance X, on which the bands 20*b* of the burn control agent are not formed and which is located at the head (the end to be lighted) of the cigarette CG, prevents lighting of the head from deteriorating and also prevents the taste of several initial puffs of the cigarette CG immediately after the lighting from deteriorating by an influence of the bands 20*b* of the burn control agent. The plural groups each having the plurality of bands 20*b* of the burn control agent and shown in FIG. 4D are formed with the second predetermined gap having the X+½·Y distance on the long web 20*a*, by forming each of the plurality of burn control agent coated region transfer areas 38 on the outer circumferential surface of the roller 30*a* as follows, the second predetermined gap providing the zone on which the plural bands of the burn control agent are not coated on the head of the wrapping paper of the cigarette CG after the long web 20*a* is rolled up by the roll-up unit 23 shown in FIG. 1 to make the long rod CB for cigarettes and then the long rod CB is cut into the plurality of cigarettes CG each having the predetermined length by the cutting unit 28. The plural groups of the bands 20*b* of the burn control agent formed intermittently with the second predetermined gap of the distance X+½·Y therebetween and shown in FIG. 4D can be formed by the second predetermined gap of the distance X+½·Y into the plural burn control agent coated region transfer areas 38 for the continuous burn control agent coated regions 20*b* shown in FIG. 4A at every positions located away from each other by the length L in the circumferential direction on the outer circumferential surface of the roller 30*a*, in this case the roller 30*a* having a circumferential length of an integral number of times as much as the length L of the single cigarette CG.

According to a principle of the present invention, each of the groups each having a plurality of bands 20*b* of the burn control agent and formed intermittently as shown in FIG. 4D may be further sectioned into desirable more small groups.

Figure 5:
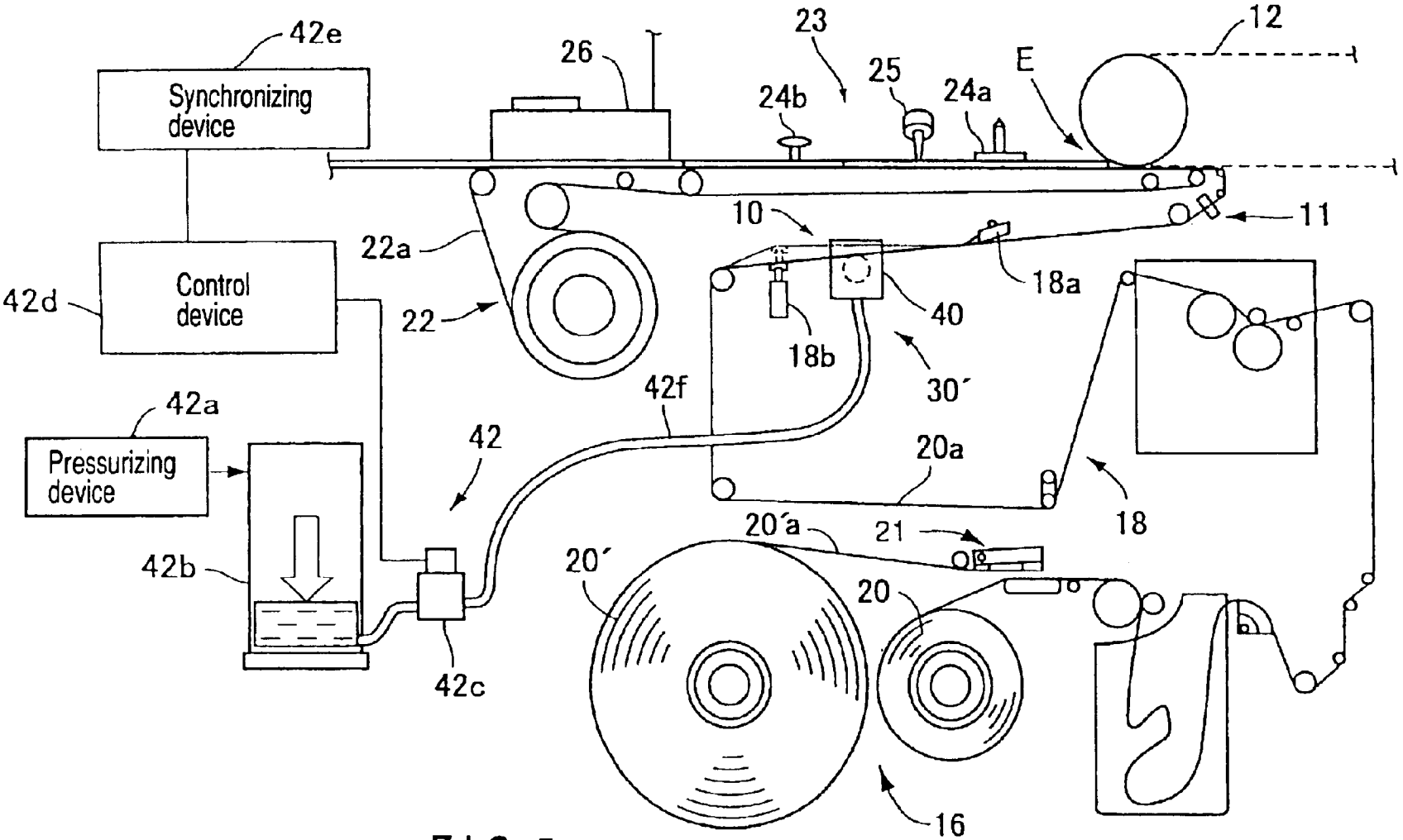
FIG. 5 is an enlarged view showing a modification of the burn control agent coated region forming unit included in the burn spread suppressing cigarette manufacturing apparatus shown in FIG. 1, together with various members and mechanisms near around the unit.

A structure of a modification of the burn control agent coated region forming unit 30 of the manufacturing apparatus for a burn spread suppressing cigarette shown in FIG. 1 will now be described in detail with reference to FIG. 1 and FIG. 5. And, FIG. 5 shows in an enlarged fashion the modification 30' of the burn control agent coated region forming unit 30 together with various members and mechanisms located near around the modification 30'.

The modified unit 30' for forming a burn control agent coated region includes a nozzle member 40 and a burn control agent supply device 42. The nozzle member 40 is in contact with or is positioned close to one surface of the long web 20*a* or 20'*a* of the wrapping paper transferred by the main portion of the wrapping paper transfer unit 18, and the burn control agent supply device 42 supplies the burn control agent to the nozzle member 40.

The burn control agent supply device 42 includes a burn control agent tank 42*b* with a pressurizing device 42*a*, a pump 42*c*, a control device 42*d* connected to the pump 42*c*, a synchronizing device 42*e* connected to the control device 42*d*, and a burn control agent transfer tube 42*f* which transfers the burn control agent from the pump 42*c* to the nozzle member 40.

Figure 6A:
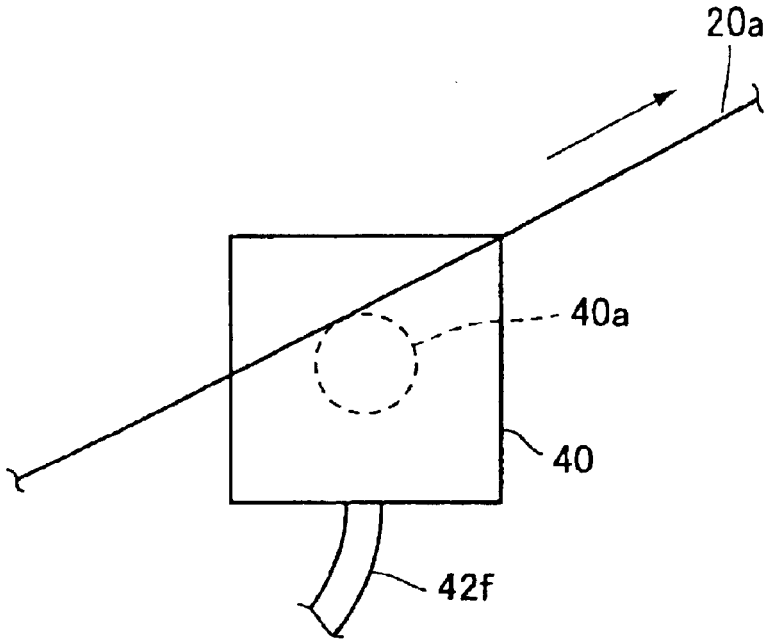
FIG. 6A is an enlarged side view showing a nozzle member of a modification of the burn control agent coated region forming unit.
Figure 6B:
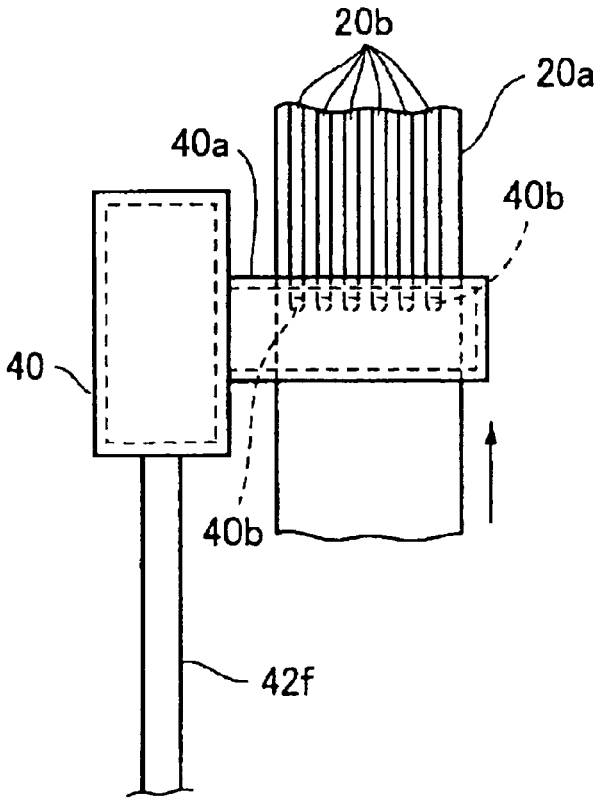
FIG. 6B is a front view of the nozzle member shown in FIG. 6A.
Figure 6C:
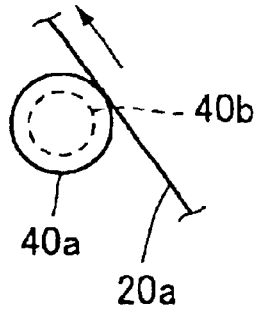
FIG. 6C is a view showing an end surface of a wrapping paper facing portion of the nozzle member as viewed in a direction exactly opposite to that for the side view shown in FIG. 6A.

A structure of the nozzle member 40 of the modified burn control agent coated region forming unit 30' will now be described in detail with reference to FIGS. 6A, 6B and 6C. Herein, FIG. 6A is a side view showing in an enlarged fashion the nozzle member 40 shown in FIG. 5, FIG. 6B is a front view showing the nozzle member 40 shown in FIG. 6A, and FIG. 6C is a side view showing an end surface of a wrapping paper facing portion 40*a* of the nozzle member 40 as viewed in a direction exactly opposite to the side view shown in FIG. 6A.

The wrapping paper facing portion 40*a* of the nozzle member 40 has a cylindrical shape and extends in parallel to one surface of the web 20*a* or 20'*a* in the width direction of the web 20*a* or 20'*a* transferred by the main portion of the wrapping paper transfer unit 18. The cylindrical wrapping paper facing portion 40*a* is in contact with or is positioned close to the one surface of the long web 20*a* or 20'*a* of the wrapping paper. A plurality of nozzle holes 40*b* are formed in the outer circumferential surface of the cylindrical portion 40*a*. In this embodiment, the nozzle holes 40*b* are arranged to correspond to the arrangement of the plurality of bands 20*b* of the burn control agent on one surface of the web 20*a* or 20'*a* in a width direction thereof, these bands 20*b* formed by the modified burn control agent coated region forming unit 30' on the web 20*a* or 20'*a* to extend in the transfer direction of the web 20*a* or 20'*a*.

The number of plural nozzle holes 40*b*, the diameter of each nozzle hole 40*b* and the distance between the adjacent two nozzle holes 40*b* correspond respectively to the number of plural bands 20*b* of the burn control agent coated regions, the width of each band 20*b* and the distance between the adjacent two bands 20*b*, these burn control agent coated regions being to be formed on one surface of the web 20*a* or 20'*a* by the modified burn control agent coated region forming unit 30'.

The synchronizing device 42*e* included in the burn control agent supply device 42 supplies a control signal to the control device 42*d* to make the control device 42*d* control the operation of the pump 42*c*. The pump 42*c* makes the nozzle member 40 apply the burn control agent through the plural nozzle holes 40*b* to the web 20*a* or 20'*a* transferred by the main portion of the wrapping paper transfer unit 18 to form a plurality of bands 20*b* of the burn control agent each having a desired length in the transfer direction of the web 20*a* or 20'*a* on a portion of the web 20*a* or 20'*a* of the wrapping paper. The portion of the web 20*a* or 20'*a* corresponds to the cigarette CG which is formed by rolling up the web 20*a* or 20'*a* together with the chopped tobacco leaves by the roll-up device 23 to form the long rod CB for cigarettes and, then, by cutting the long rod CB into the cigarettes CB by the cutting unit 28, in the manufacturing apparatus for a burn spread suppressing cigarette shown in FIG. 1. And, the desired length of the bands 20*b* is set on the basis of the longitudinal length of each cigarette CG.

The synchronizing device 42*e* may use an encoder mounted to, for example, the guide or support roller included in the wrapping paper transfer unit 18.

The control device 42*d* controls the operation of the pump 42*c* in synchronism with the transferred distance of the web 20*a* or 20'*a* corresponding to the length of one cigarette CG in the wrapping paper transfer unit 18, the transferred distance of the web 20*a* or 20'*a* being detected by the synchronizing device 42*e* and being informed from the device 42*e* to the control device 42*d*. As a result of this, the nozzle member 40 can form the plurality of desired bands 20*b* of the burn control agent on one surface of the web 20*a* or 20'*a* by applying the burn control agent through the plural nozzle holes 40*b*, as shown in, for example, FIG. 6B.

The modified burn control agent coated region forming unit 30', as in the case of using the roller 30*a* of the burn control agent coated region forming unit 30 described previously with reference to FIGS. 2 and 3, can also form various kinds of patterns of the burn control agent coated regions including the plural bands of the burn control agent shown in FIGS. 4A to 4D on the long web 20*a* or 20'*a* of the wrapping paper.

Various kinds of substances that can be used as the burn control agent are known in the art and includes, for example, proteins such as gelatin, casein, albumin, and gluten; polysaccharides each performing a thickening function such as starch, xanthane gum (echo gum), locust bean gum, guar gum (guar pack), tragacanth gum, tara gum, tamalindo seed polysaccharides (glyroid), karaya gum, gum arabic, pulran, dextrin, cyclodextrin, (oligoseven), and gutty; polysaccharides performing a gelling function such as carrageenan, curdlan, agar, gelatin, farselran, pectin, jeram gum, and kelco gel; lipids such as lecithin; natural high molecular weight derivatives such as carboxymethyl cellulose (CMC), methyl cellulose (MC), propylene glycol alginate ester (PGA), and a processed starch such as starch phosphate; synthetic high molecular weight compounds such as poly (sodium acrylate) and various high molecular weight emulsifying agents; inorganic ammonium salts such as ammonium chloride, ammonium hydrogen phosphate, ammonium dihydrogen phosphate, ammonium bromide and ammonium sulfate; inorganic hydroxides such as barium hydroxide, calcium hydroxide, and aluminum hydroxide; and inorganic salt flame retardants such as sodium borate, boric acid, zinc chloride, magnesium chloride, calcium chloride and sodium sulfate. These combustion control agents can be used singly or in the form of a mixture of at least two kinds of these combustion control agents.

The inspecting unit 11 which is used for inspecting a wrapping paper for a burn spread suppressing cigarette and which has a novel structure in the manufacturing apparatus for manufacturing a burn spread suppressing cigarette shown in FIG. 1, will now be described in detail with reference to FIGS. 7 to 9 in addition to FIG. 1.

Figure 7:
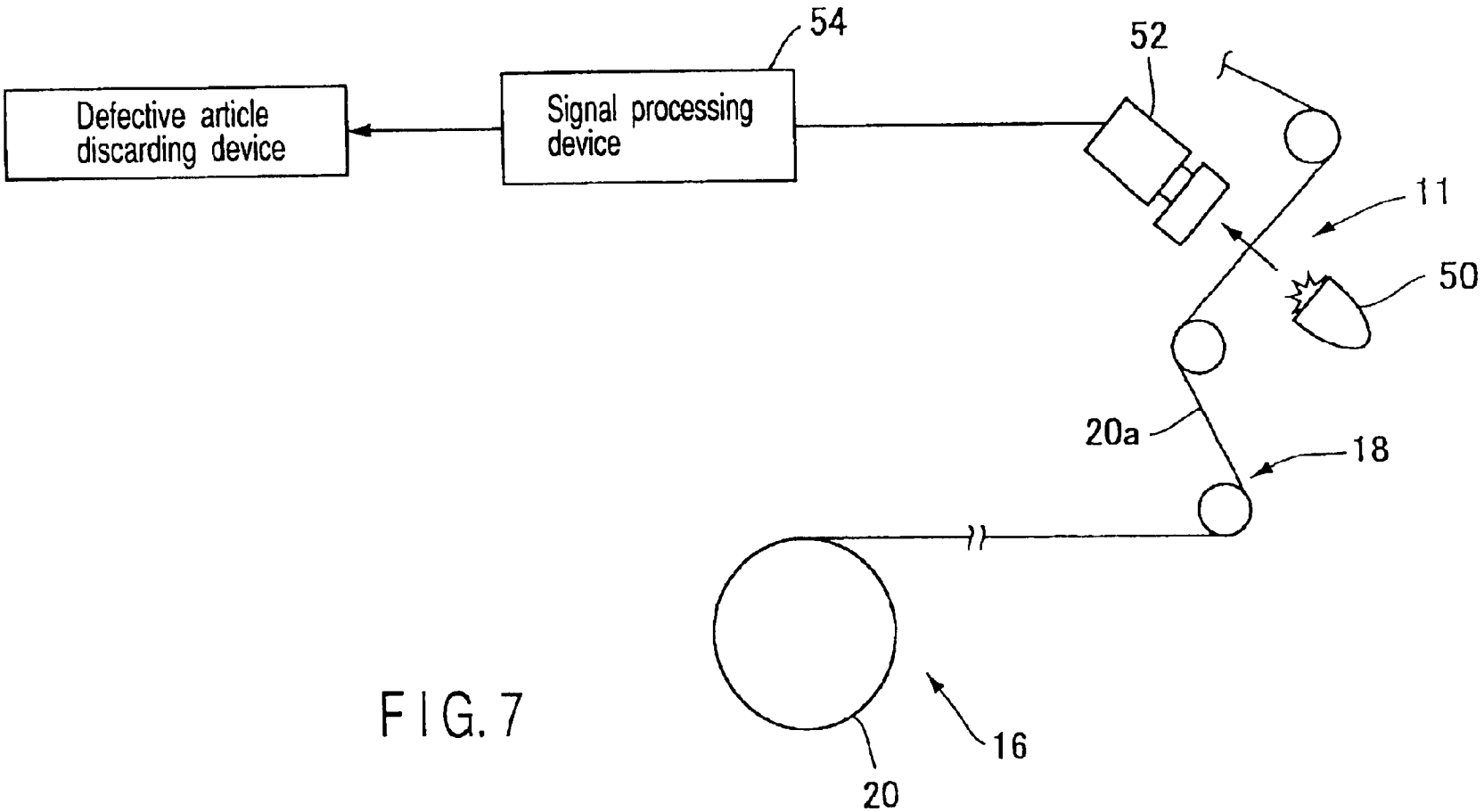
FIG. 7 schematically shows in an enlarged fashion the inspecting unit which inspects a cigarette wrapping paper for a burn spread suppressing cigarette and which is included in the apparatus for manufacturing a burn spread suppressing cigarette shown in FIG. 1, together with a unit which discard a defective article.
Figure 8A:
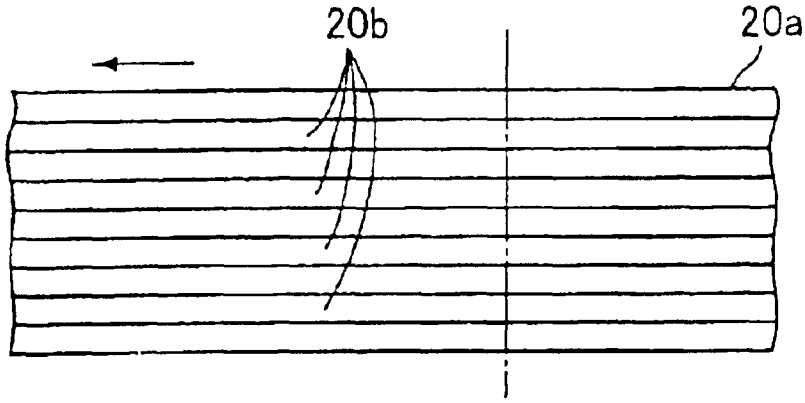
FIG. 8A is a plan view schematically showing how the cigarette wrapping paper inspecting unit shown in FIG. 7 inspects a plurality of bands of a burn control agent, which are formed on the long web of the wrapping paper transferred by the wrapping paper transfer unit shown in FIG. 1, the band being the burn control agent coated region formed by the apparatus for manufacturing a burn spread suppressing cigarette shown in FIG. 1.
Figure 8B:
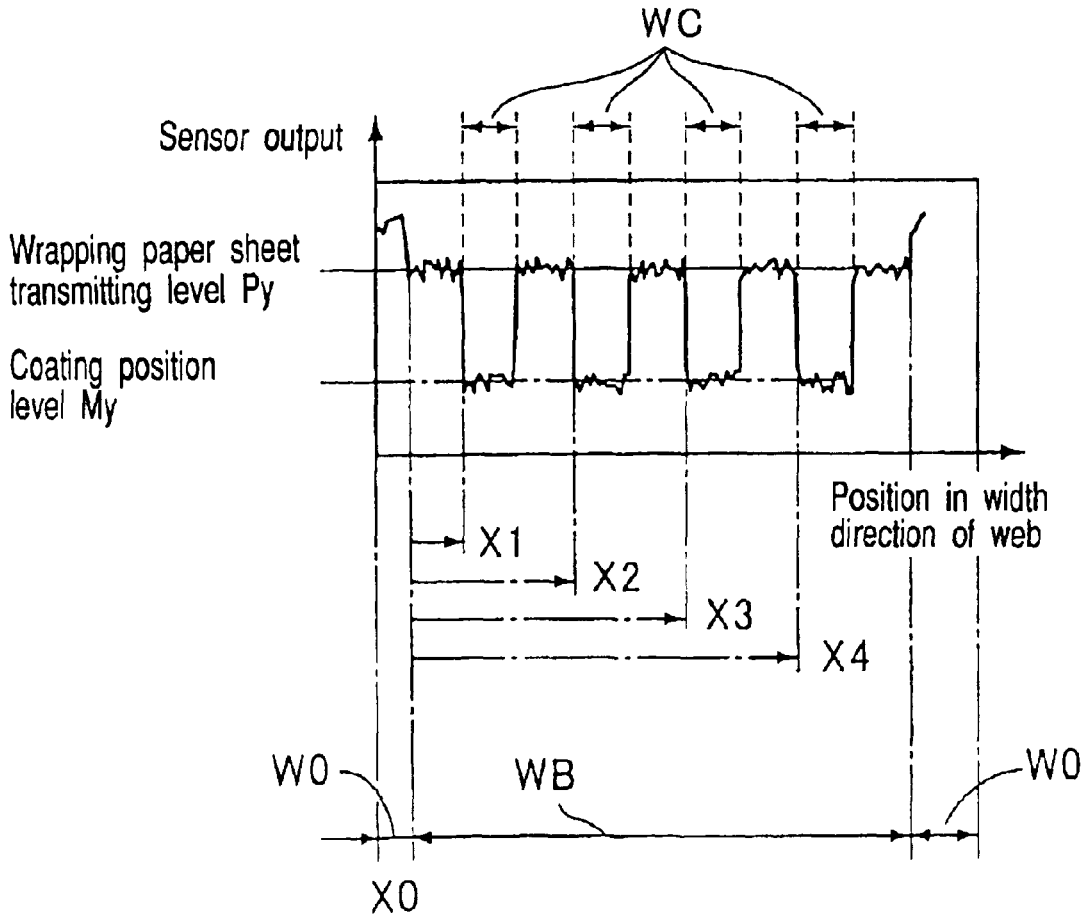
FIG. 8B shows results of detection performed as shown in FIG. 8A by the inspecting unit which inspects the wrapping paper for a burn spread suppressing cigarette.
Figure 9:
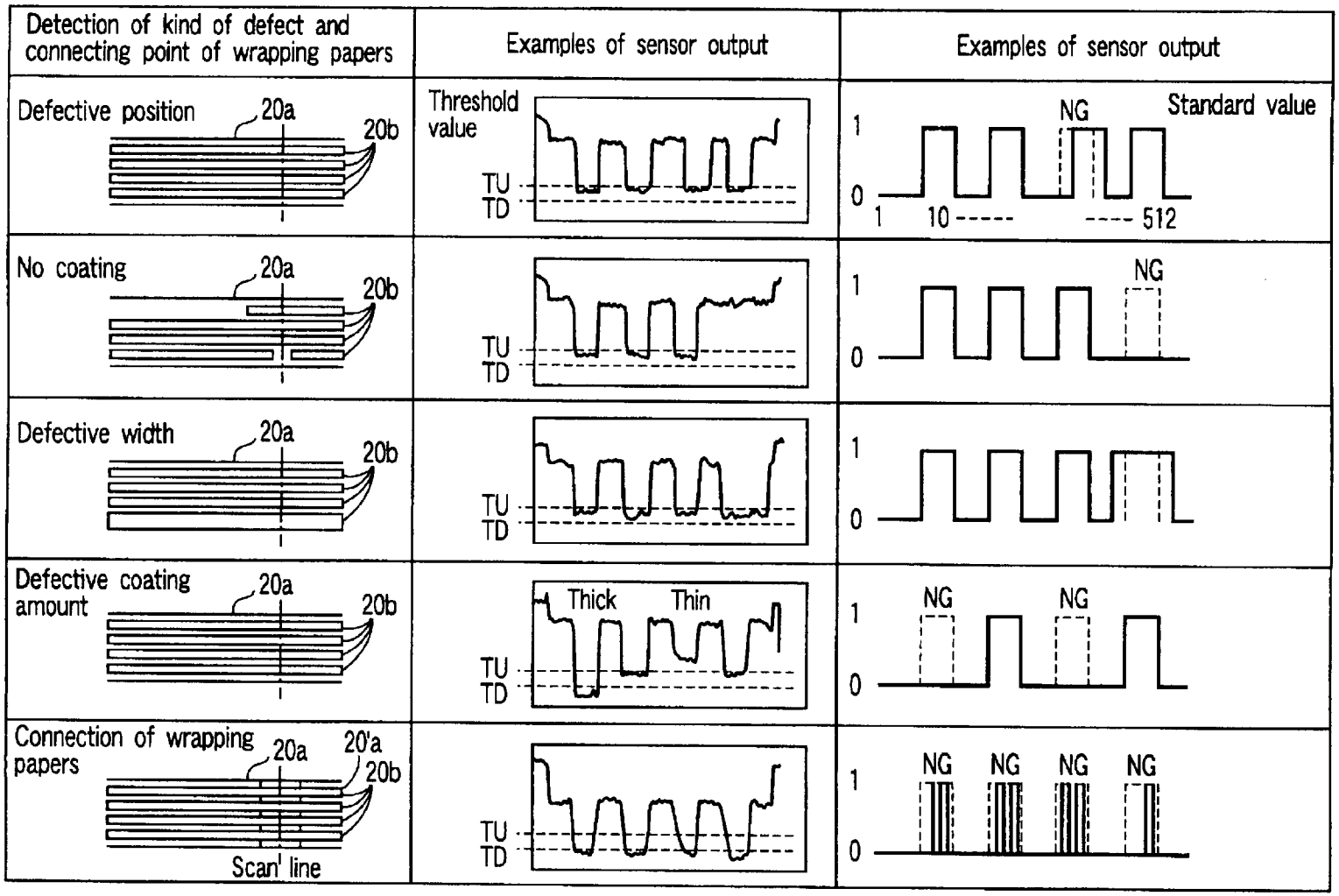
FIG. 9 shows results of various inspections that can be performed by the cigarette wrapping paper inspecting unit shown in FIG. 7.

In FIGS. 7 to 9, FIG. 7 is a side view schematically showing a structure of the inspecting unit 11 which inspects a wrapping paper for a burn spread suppressing cigarette; FIG. 8A is a plan view schematically showing how the cigarette wrapping paper inspecting unit shown in FIG. 7 inspects a plurality of bands 20*b* of a burn control agent formed on the long web 20*a* or 20'*a* of the wrapping paper transferred by the wrapping paper transfer unit 18 shown in FIG. 1, the bands formed by the manufacturing apparatus 10 shown in FIG. 1 for a burn spread suppressing cigarette; FIG. 8B shows results of inspection performed as shown in FIG. 8A by the inspecting unit 11 which inspects the wrapping paper for a burn spread suppressing cigarette; and FIG. 9 shows results of various inspections that can be performed by the cigarette wrapping paper inspecting unit 11 shown in FIG. 7.

As shown in FIG. 7, the inspecting unit 11 which inspects a wrapping paper for a burn spread suppressing cigarette includes a light source 50 and a light intensity detecting device 52. The light source 50 is positioned to face one surface of the long web 20*a* or 20'*a* of the wrapping paper transferred by the wrapping paper transfer unit 18 shown in FIG. 1, on the one surface of which a desired pattern of the plurality of bands 20*b* of the burn control agent are formed by the manufacturing device 10 which is shown in FIG. 1 and manufactures a wrapping paper for a burn spread suppressing cigarette. And, the light intensity detecting device 52 is positioned to face another surface of the web 20*a* or 20'*a* opposite to the above described one surface thereof and detects the intensity of the light projected from the light source 50 and transmitted through the web 20*a* or 20'*a*.

The light source 50 is a line-shaped lighting device extending in a direction perpendicular to the transfer direction of the long web 20*a* or 20'*a* of the wrapping paper transferred by the wrapping paper transfer unit 18. In other words, the line-shaped lighting device forming the light source 50 extends in the width direction of the web 20*a* or 20'*a* as denoted by one-dot chain line shown in FIG. 8A so as to light the one surface of the web 20*a* or 20'*a* with a uniform intensity of illumination in the width direction of the web 20*a* or 20'*a*.

The light intensity detecting device 52 is a line sensor which is arranged in the side of the other surface of the web 20*a* or 20'*a* in symmetry with the light source 50 arranged in the side of the one surface of the web 20*a* or 20'*a*, and which extends in a direction perpendicular to the transfer direction of the long web 20*a* or 20'*a* of the wrapping paper transferred by the wrapping paper sheet transfer unit 18, i.e., extending in the width direction of the web 20*a* or 20*a*, as denoted by the one-dot chain line shown in FIG. 8A. The detecting device 52 uses a CCD (Charge Coupled Device) to detect the intensity of the transmitting light.

The line sensor acting as the light intensity detecting device 52 may be replaced with a plurality of spot sensors which are arranged in the side of the other surface of the web 20*a* or 20'*a* in symmetry with the light source 50 arranged in the side of the one surface of the web 20*a* or 20'*a*, and which corresponds to only a plurality of bands 20*b* of the burn control agent on the web 20*a* or 20'*a* on a line extending in the width direction of the web 20*a* or 20'*a*.

A signal processing device 54 which processes a signal outputted from the light intensity detecting device 52 is connected to the light intensity detecting device 52, and a defective article discarding device is connected to the signal processing device 54. Usually, the defective article discarding device is combined with a filter connecting device which connects a filter to the cigarette CG supplied from the cigarette manufacturing apparatus with a chip paper.

FIG. 8B shows the results of detection when the light intensity detecting device 52 detects the intensity of the light transmitting through the plurality of bands 20*b* of the burn control agent formed on the web 20*a* shown in FIG. 8A. The results of detection are shown as the outputs of the line sensor of the light intensity detecting device 52 at the positions in the width direction of the web.

As apparent from FIG. 8B, the intensity of the light is weaker in the range WB in which the web 20*a* is present in the width direction of the web than in the outside WO of the web 20*a*. The intensity of the light is further weakened in small ranges WC corresponding to the plurality of bands 20*b* of the burn control agent included in the range WB in which the web 20*b* is present.

The density of each of the bands 20*b* of the burn control agent corresponding to the small ranges WC can be known from the degree of output in each of the small ranges WC, the width of each of the bands 20*b* of the burn control agent corresponding to the small ranges WC can be known from the outputs in each of the small ranges WC, and the number of bands 20*b* of the burn control agent formed on the web 20*a* can be known from the number of small ranges WC included in the range WB in which the web 20*a* is present. Further, the distribution of the plurality of bans 20*b* of the burn control agent in the width direction on the web 20*a* can be known from the distribution of the plurality of small ranges WC within the range WB in which the web 20*a* is present. More further, the distance in the width direction between the adjacent two bands 20*b* of the burn control agent formed on the web 20*a* can be known from the distance in the width direction between the adjacent two small ranges WC within the range WB in which the web 20*a* is present.

FIG. 9 shows the results of inspection in which the output from the line sensor of the light intensity detecting device 52 is converted into a binary signal by the signal processing device 54 so that various defects of the wrapping paper in respect of the coating of the burn control agent and the connecting point of the wrapping papers are judged.

In an example of the defective position, it is judged that a single band 20*b* of the burn control agent among a predetermined number of bands 20*b* of the burn control agent, which must be in a predetermined density and must be arranged in a predetermined arrangement in the width direction of the web 20*a*, is deviated from its predetermined position in the width direction of the web, on a basis of the output from the line sensor of the light intensity detecting device 52 along the width direction of the web.

In an example in which the coating was not applied, it is judged that a single band 20*b* of the burn control agent among a predetermined number of bands 20*b* of the burn control agent, which must be in a predetermined density and must be arranged in a predetermined arrangement in the width direction of the web 20*a*, was not formed (coated), on a basis of the output from the line sensor of the light intensity detecting device 52 along the width direction of the web.

In an example of the defective width, it is judged that a single band 20*b* of the burn control agent among a predetermined number of bands 20*b* of the burn control agent, which must be in a predetermined density and must be arranged in a predetermined arrangement in the width direction of the web 20*a*, failed to have a width of a predetermined value, on a basis of the output from the line sensor of the light intensity detecting device 52 along the width direction of the web.

Further, in an example of the defective coating amount, it is judged that two bands 20*b* of the burn control agent among predetermined number of bands 20*b* of the burn control agent, which must be in a predetermined density and must be arranged in a predetermined arrangement, failed to have densities of predetermined values, on a basis of the output from the line sensor of the light intensity detecting device 52 along the width direction of the web. In this example, one of the two defective bands 20*b* of the burn control agent has a density exceeding the upper threshold value of a predetermined range of the density, and it is detected by the line sensor as the sensor detects the lower limit TD of a predetermined output range corresponding to the predetermined range of the density. Also, the other defective band 20*b* of the burn control agent has a density failing to reach the lower threshold value of the predetermined range of the density, and it is detected by the line sensor as the sensor detects the upper limit TU of the predetermined output range corresponding to the predetermined range of the density. This means that the density of the other defective band 20*b* is lower than the predetermined range of the density.

In an example of a detection of a connecting point of wrapping papers, the connecting point at which the leading end of the long web 20' of the secondly supplied wrapping paper is connected by the automatic connecting device 22 to the trailing end of the long web 20 of the firstly supplied wrapping paper in the wrapping paper supply source 16 shown in FIG. 1, is detected on a basis of that all of the output levels in the connecting point at the bands 20*b* of the burn control agent on the web 20*a* and at zones out of the bands 20*b* on the web 20*a* are uniformly lower than those in points other than the connecting point at the bands 20*b* and at zones out of the bands 20*b* on the web 20*a*, the bands 20*b* must being in a predetermined density and must be arranged in a predetermined arrangement in the width direction of the web 20*a*.

When the signal processing device 54 has detected the above described various defects of the predetermined number of bands 20*b* of the burn control agent, which must be formed in a predetermined density and in a predetermined arrangement on the long web 20 or 20' of the wrapping paper, or the connecting points between the two long webs 20 and 20' of the wrapping papers on the basis of the output generated from the light intensity detecting device 52, the cigarette CG having a portion of the wrapping paper which includes each of the above described various defects or the connecting portion can be excluded from the non-defective normal cigarettes CG by the above described defective article discarding device (not shown) utilizing a structure equal to the synchronizing device 42*e* used in the modified unit 30' for forming a burn control agent coated region shown in FIG. 5, just after the cigarettes CG are formed by cutting the long rod CB by the cutting unit 28 shown in FIG. 1.

Needless to say, the signal processing device 54 can detect the presence or absence of each of the plurality of bands 20*b* of the burn control agent in the direction which is the longitudinal direction of the long web 20 or 20' of the wrapping paper when the web 20*a* or 20'*a* is rolled up to produce the long rod CB for cigarettes CG, that is, in the transfer direction of the web 20*a* or 20'*a* transferred by the wrapping paper transfer unit 18 in the embodiment shown in the drawings on the basis of the output from the light intensity detecting device 52, while the web 20 or 20' is transferred at a predetermined speed by the wrapping paper transfer unit 18.

Therefore, the length of that portion in which each of the plural bands 20*b* of the burn control agent is not present in the web 20*a* or 20'*a* in the direction which is to be the longitudinal direction as described above can be known from the time during which the light intensity detecting device 52 does not detect each of the plural bands 20*b* of the burn control agent and the transfer speed of the web 20 or 20' transferred by the wrapping paper transfer unit 18. Further, it is possible to detect the distance of a portion of the web 20*a* or 20'*a* on the portion of which the plural bands 20*b* of the burn control agent are not formed in the transfer direction of the web 20*a* or 20'*a*, that portion corresponding to the head of the individual cigarette CG prepared by rolling up the long web 20 or 20' of the wrapping paper to make the long rod CB for cigarettes and by cutting the long rod.

Further, it is possible to detect the specific values of the above described predetermined distance and further to detect that the above described predetermined distance is set to fall within a range between about 10 mm and about 25 mm.

Figure 10A:
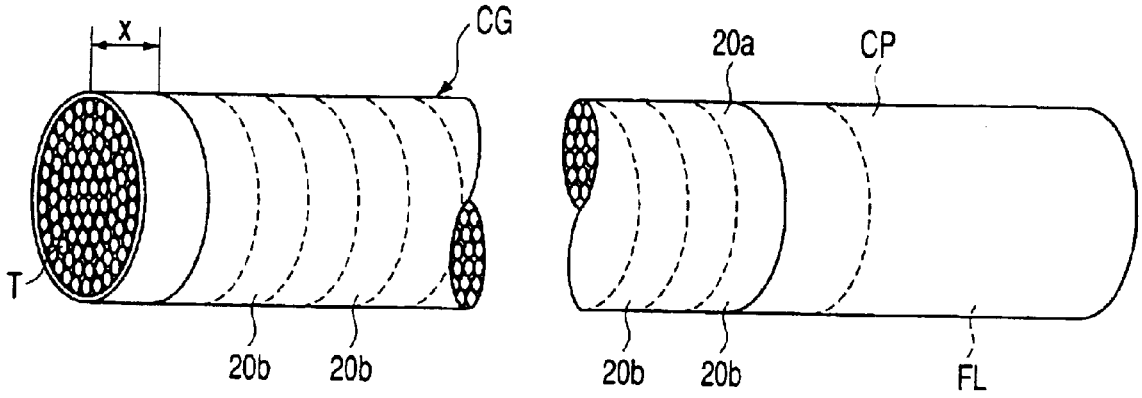
FIG. 10A is an enlarged oblique view schematically showing another example of a burn spread suppressing cigarette which can be manufactured by the apparatus for manufacturing a burn spread suppressing cigarette of the present invention.

Needless to say, according to an aspect of the invention, the method of manufacturing a burn spread suppressing cigarette, of the present invention, form the plurality of bands 20*b* of the burn control agent on the web 20*a* or 20'*a* transferred by the wrapping paper transfer unit 18 at desired intervals in the direction which is the longitudinal direction when the web 20*a* or 20'*a* is rolled up to prepare the long rod CB for cigarettes by the roll-up unit 23 such that each band 20*b* extends over the entire length or a predetermined length of the cigarette in a direction perpendicular to the longitudinal direction of the cigarette, as shown in FIG. 10A.

In this case, it is desirable that the plural circumferentially extending bands 20*b* of the burn control agent are formed on that surface of the web 20 or 20' which becomes an inner surface when the web 20 or 20' is rolled up by the roll-up device 23 to provide the long rod CB for cigarettes.

These plural circumferentially extending bands 20*b* of the burn control agent are formed in the burn control agent coated region forming unit 30 as shown in FIGS. 3A and 3B by forming burn control agent coated region transfer areas on the outer circumference of the roller 30*a* at a plurality of positions separated from each other in the circumferential direction of the roller 30*a* to extend along the center line of the rotation of the roller 30*a*. Also, in the burn control agent coated region forming unit 30' as shown in FIGS. 6A to 6C, the circumferentially extending plural bands 20*b* of the burn control agent are formed by shortening the ejection time for ejecting the burn control agent from the plurality of nozzle holes 40*b* of the nozzle member 40 onto the web 20 or 20' transferred by the wrapping paper transfer unit 18.

Figure 10B:
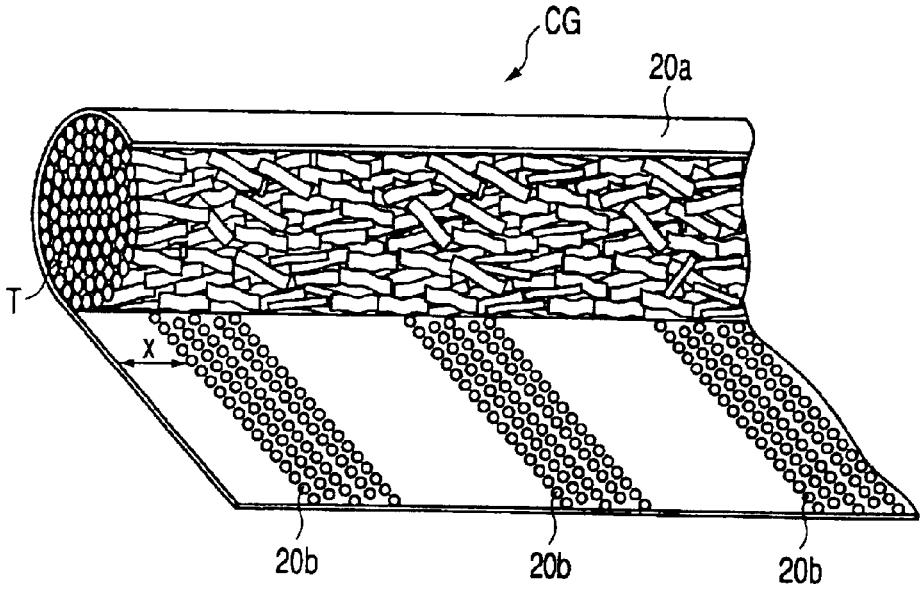
FIG. 10B is an enlarged oblique view schematically showing still another example of a burn spread suppressing cigarette which can be manufactured by the apparatus for manufacturing a burn spread suppressing cigarette of the present invention.

Further, the burn control agent coated region formed on the web 20 or 20' may be an aggregation of a large number of small dots as shown in FIG. 10B. The burn control agent coated region of the aggregation of a large number of small dots may extend on the web 20*a* or 20'*a* in a direction perpendicular to the direction which becomes the longitudinal direction when the web 20 or 20' is rolled up by the roll-up unit 23 to form the long rod CB for cigarettes, as shown in FIG. 10B. Alternatively, the burn control agent coated region of the aggregation of a large number of small dots may extend in the direction which becomes the longitudinal direction when the web 20 or 20' is rolled up by the roll-up unit 23 to form the long rod CB for cigarettes, as shown in FIG. 4E. Further, the number of the band-like burn control agent coated regions, each formed by the aggregation of a large number of small dots, may be set freely and the boundary of each of the band-like burn control agent coated regions may be unclear. Still further, the burn control agent coated regions may be formed on the web 20*a* or 20'*a* in various distributions (including the pattern and the number) other than the band-like shape.

The burn control agent coated region of the aggregation of a large number of small dots of the burn control agent allows a more precise burn control.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing burn spread suppressing cigarette, comprising:

transferring a wrapping paper for a cigarette;

forming a burn control agent coated region on the transferred wrapping paper;

inspecting a distribution and density of the burn control agent coated region formed on the wrapping paper;

supplying chopped tobacco leaves to the wrapping paper on which the burn control agent coated region is formed;

rolling up the wrapping paper on which the chopped tobacco leaves are supplied, together with the chopped tobacco leaves; and cutting the rolled-up wrapping paper rolled up, together with the chopped tobacco leaves, to correspond to the longitudinal length of the cigarette.

2. The method according to claim 1, wherein, in the forming of the burn control agent coated region, a formation of the burn control agent coated region is performed in synchronism with a cutting operation of the rolled-up wrapping paper.

3. The method according to claim 1, wherein, in the inspection of the burn control agent coated region, a light is projected on one surface of the wrapping paper for the cigarette after formation of the burn control agent coated region, light transmitted through the wrapping paper for the cigarette is detected in a side of the other surface of the wrapping paper after formation of the burn control agent coated region, and the distribution and density of the burn control agent coated region formed on the wrapping paper is inspected on a basis of intensity distribution of the transmitted light.

4. The method according to claim 1, wherein, in the formation of the burn control agent coated region, the burn control agent coated region is formed on that surface of the wrapping paper which becomes an inner surface when the wrapping paper is rolled up for a cigarette.

5. The method according to claim 1, wherein, in the formation of the burn control agent coated region, a plurality of bands of the burn control agent are formed to extend in a direction which becomes a longitudinal direction when the wrapping paper is rolled up for a cigarette.

6. The method according to claim 5, wherein, in the formation of the burn control agent coated region, a plurality of bands of the burn control agent are formed to extend intermittently in the direction which becomes the longitudinal direction when the wrapping paper is rolled up for a cigarette, with a predetermined gap in the longitudinal direction.

7. The method according to claim 1, wherein, in the formation of the burn control agent coated region, the burn control agent coated region is not formed on a portion of the wrapping paper, the portion of the wrapping paper becoming a head of the cigarette when the wrapping paper is rolled up to the cigarette, and the head having a predetermined length in the longitudinal direction of the cigarette.

8. The method according to claim 7, wherein the predetermined length is set within a range between about 10 mm and about 25 mm.

9. The method according to claim 1, wherein, in the formation of the burn control agent coated region, a roller is in contact with the transferred wrapping paper and is rotated in the transfer direction, a burn control agent coated region transfer area corresponding to the burn control agent coated region is formed on the outer circumferential surface of the roller, and the burn control agent supplied from a burn control agent applying device is applied onto the outer circumferential surface of the roller by the burn control agent applying device.

10. The method according to claim 1, wherein, in the formation of the burn control agent coated region, a nozzle member is in contact with or is positioned close to the transferred wrapping paper, a plurality of nozzle holes are formed in the nozzle member, and the burn control agent is supplied to the nozzle member from a burn control agent supply device.

11. An apparatus for manufacturing a burn spread suppressing cigarette, comprising:

a wrapping paper transfer unit which transfers a wrapping paper for a cigarette;

a burn control agent coated region forming unit which forms a burn control agent coated region on the wrapping paper transferred by the wrapping paper transfer unit;

a chopped tobacco leaf supply unit which supplies chopped tobacco leaves to the wrapping paper on which the burn control agent coated region is formed by the burn control agent coated region forming unit;

a roll-up unit which rolls up the wrapping paper on which the chopped tobacco leaves are supplied from the chopped tobacco leaf supplying unit, together with the chopped tobacco leaves, to form a cigarette; and a cigarette cutting unit which cuts the rolled up wrapping paper, which is rolled up together with the chopped tobacco leaves by the roll-up unit for a cigarette, in a predetermined longitudinal length of the cigarette, further comprising a burn control agent coated region inspecting unit which inspects a distribution and density of the burn control agent coated region formed on the wrapping paper after formation of the burn control agent coated region on the wrapping paper by the burn control agent coated region forming unit, and before supply of the chopped tobacco leaves performed by the chopped tobacco leaf supply unit.

12. The apparatus according to claim 11, wherein the burn control agent coated region forming unit forms the burn control agent coated region on the wrapping paper in synchronism with a cutting operation of the rolled-up wrapping paper performed by the cigarette cutting unit.

13. The apparatus according to claim 11, wherein the burn control agent coated region inspecting unit projects light on one surface of the wrapping paper for the cigarette after formation of the burn control agent coated region, detects light transmitted through the wrapping paper for the cigarette in a side of the other surface of the wrapping paper after formation of the burn control agent coated region, and inspects the distribution and density of the burn control agent coated region formed on the wrapping paper on a basis of intensity distribution of the transmitted light.

14. The apparatus according to claim 11, wherein the burn control agent coated region forming unit is arranged to be in contact with the wrapping paper transferred by the wrapping paper transfer unit, and comprises a wrapping paper shift unit which selectively shifts the wrapping paper transferred by the wrapping paper transfer unit to be brought into contact with the burn control agent coated region forming unit.

15. The apparatus according to claim 14, wherein the wrapping paper shift unit shifts the wrapping paper to separate from the burn control agent coated region forming unit while the transfer of the wrapping paper by the wrapping paper transfer unit is stopped.

16. The apparatus according to claim 11, wherein the burn control agent coated region forming unit forms a plurality of bands of the burn control agent to extend in a direction which becomes a longitudinal direction when the wrapping paper is rolled up for a cigarette.

17. The apparatus according to claim 16, wherein the burn control agent coated region forming unit forms a plurality of bands of the burn control agent to extend intermittently in the direction which becomes the longitudinal direction when the wrapping paper is rolled up for a cigarette, with a predetermined gap in the longitudinal direction.

18. The apparatus according to of claim 11, wherein the burn control agent coated region forming unit does not form the burn control agent coated region on a position of the wrapping paper, the position of the wrapping paper becoming a head of the cigarette when the wrapping paper is rolled up to the cigarette, and the head having a predetermined length in the longitudinal direction of the cigarette.

19. The apparatus according to claim 18, wherein the predetermined length is set within a range between about 10 mm and about 25 mm.

20. The apparatus according to claim 11, wherein the burn control agent coated region forming unit forms the burn control agent coated region on that surface of the wrapping paper which becomes an inner surface when the wrapping paper is rolled up for a cigarette.

21. The apparatus according to claim 11, wherein the transfer direction of the wrapping paper by the wrapping paper transfer unit is the direction which becomes a longitudinal direction when the wrapping paper is rolled up for a cigarette, and the burn control agent coated region forming unit includes a roller that is in contact with the wrapping paper transferred by the wrapping paper transfer unit and is rotated in the transfer direction of the wrapping paper burn control agent coated region transfer area corresponding to the burn control agent coated region and formed on the outer circumferential surface of the roller, and a burn control agent applying device which supplies the burn control agent onto the outer circumferential surface of the roller and applies the burn control agent to the outer circumferential surface of the roller.

22. The apparatus according to claim 11, wherein the transfer direction of the wrapping paper by the wrapping paper transfer unit is the direction which becomes a longitudinal direction when the wrapping paper is rolled up for a cigarette, and the burn control agent coated region forming unit includes a nozzle member which is in contact with or is positioned close to the wrapping paper transferred by the wrapping paper transfer unit, a plurality of nozzle holes formed in the nozzle member, and a burn control agent supply device which supplies the burn control agent to the nozzle member.

* * * * *